US010258122B2

(12) United States Patent
Bongiorno

(10) Patent No.: US 10,258,122 B2
(45) **Date of Patent: *Apr. 16, 2019**

(54) TOILETRY ORGANIZER CASE/DISPLAY STAND FOR USE WITH A SUITCASE

(71) Applicant: James Bongiorno, Huntington, NY (US)

(72) Inventor: James Bongiorno, Huntington, NY (US)

( * ) Notice: Subject to any disclaimer, the term of this patent is extended or adjusted under 35 U.S.C. 154(b) by 189 days.

This patent is subject to a terminal disclaimer.

(21) Appl. No.: 15/412,031

(22) Filed: Jan. 22, 2017

(65) Prior Publication Data

US 2017/0231342 A1 Aug. 17, 2017

Related U.S. Application Data

(63) Continuation of application No. 14/297,407, filed on Jun. 5, 2014, now Pat. No. 9,554,631.

(51) Int. Cl.

| | |
|---|---|
| ***A45C 5/00*** | (2006.01) |
| ***A45C 11/00*** | (2006.01) |
| ***A45C 13/00*** | (2006.01) |
| ***A45C 13/02*** | (2006.01) |
| ***A45C 5/03*** | (2006.01) |

(52) U.S. Cl.

CPC ..... *A45C 5/005* (2013.01); *A45C 5/03* (2013.01); *A45C 11/008* (2013.01); *A45C 13/00* (2013.01); *A45C 13/02* (2013.01); *A45C 2011/007* (2013.01); *A45C 2013/026* (2013.01); *A45C 2200/15* (2013.01)

(58) Field of Classification Search

CPC ..... A45C 5/005; A45C 5/03; A45C 11/008; A45C 13/00; A45C 13/02; A45C 2011/007; A45C 2013/026; A45C 2220/15

See application file for complete search history.

(56) References Cited

U.S. PATENT DOCUMENTS

| | | | |
|---|---|---|---|
| 504,840 | A | 9/1893 | Krick |
| 754,227 | A | 3/1904 | Moog |
| 838,031 | A | 12/1906 | Kirkpatrick |
| 1,206,276 | A | 11/1916 | Wallach |
| 1,452,278 | A | 4/1923 | Kind |

(Continued)

FOREIGN PATENT DOCUMENTS

| | | |
|---|---|---|
| WO | WO 2000062639 | 10/2000 |
| WO | WO 2008024216 | 2/2008 |

*Primary Examiner* — Tri M Mai

(57) ABSTRACT

A case assembly is configured for organized carrying of toiletries in a leak-proof manner within a suitcase, and for subsequent displaying of the toiletries within the case on a vanity countertop, particularly on hotel/motel and other guest-like bathroom vanities. A contour of an exterior portion of the case assembly is configured to corresponding/match a contoured portion of the suitcase interior, and to have an extent matching a full depth of the suitcase, to optimize space occupied therein. The case assembly includes: a case; a seal member; a cover configured to enclose the opening in the case, in a closed position; a cover support arm permitting selective pivotal movements of the cover; a latch to secure the cover in a leak-proof manner, in the closed position; and a display arm pivotally coupled to the cover, and configured to support the opened case cover at a desired display angle.

12 Claims, 22 Drawing Sheets

(56) References Cited

U.S. PATENT DOCUMENTS

| | | | |
|---|---|---|---|
| 1,485,172 | A | 2/1924 | Dowell |
| 1,493,097 | A | 5/1924 | Blood |
| 1,683,851 | A | 9/1928 | Wells |
| 1,684,091 | A | 9/1928 | Halk |
| 1,705,149 | A | 3/1929 | Brady |
| 1,722,507 | A | 7/1929 | Stanley |
| 1,732,214 | A | 10/1929 | Amez-Droz |
| 1,752,948 | A | 4/1930 | Herrmann |
| 1,975,294 | A | 9/1931 | Sand |
| 1,915,007 | A | 6/1933 | Weiss |
| 1,919,012 | A | 7/1933 | Diskin |
| 1,999,328 | A | 4/1935 | Lessard |
| 2,131,583 | A | 6/1937 | Crotty |
| 2,167,926 | A | 8/1939 | Glasker |
| 2,168,073 | A | 8/1939 | Schnider |
| 2,415,220 | A | 4/1947 | Ritter |
| 2,419,165 | A | 4/1947 | Renz |
| 2,573,763 | A | 7/1947 | Graham |
| 2,513,013 | A | 6/1950 | Feldman |
| 2,529,724 | A | 11/1950 | Conwiser |
| 2,612,199 | A | 9/1952 | Schocket |
| 2,623,566 | A | 12/1952 | Kibler |
| 2,631,632 | A | 3/1953 | Leachman |
| 2,648,366 | A | 8/1953 | Higbee |
| 2,707,538 | A | 5/1955 | Mayer |
| 2,967,608 | A | 1/1961 | Linker |
| 3,258,017 | A | 6/1966 | Albert |
| 3,323,638 | A | 6/1967 | Dishart |
| 3,397,706 | A | 8/1968 | Hogan |
| 3,414,033 | A | 12/1968 | Tucker |
| 3,530,961 | A | 9/1970 | Weissenbach |
| 3,537,552 | A | 11/1970 | Noble |
| 3,777,862 | A | 12/1973 | Zipper |
| 3,870,132 | A | 3/1975 | Hanley |
| 3,933,229 | A | 1/1976 | Pelavin |
| 4,027,754 | A | 6/1977 | Walker |
| 4,119,181 | A | 10/1978 | Jones |
| 4,121,600 | A | 10/1978 | Riddick |
| 4,263,951 | A | 4/1981 | Siegel |
| 4,412,604 | A | 11/1983 | Bell |
| 4,418,806 | A | 12/1983 | Johnson |
| 4,461,332 | A | 7/1984 | Parkhurst |
| 4,506,769 | A | 3/1985 | Franco |
| 4,718,524 | A | 1/1988 | Crumley |
| 4,738,340 | A | 4/1988 | Crespi |
| 4,753,329 | A | 6/1988 | Choy |
| 4,817,791 | A | 4/1989 | Adams |
| 4,854,431 | A | 8/1989 | Pulichino |
| 4,854,432 | A | 8/1989 | Carpenter |
| 4,887,751 | A | 12/1989 | Lehman |
| 4,925,021 | A | 5/1990 | Pulichino |
| 4,960,204 | A | 10/1990 | Young |
| 4,966,258 | A | 10/1990 | Hawley |
| 5,020,673 | A | 6/1991 | Adams |
| 5,052,555 | A | 10/1991 | Harmon |
| 5,054,589 | A | 10/1991 | Bomes |
| RE33,794 | E | 1/1992 | King |
| 5,095,924 | A | 3/1992 | Stanfield |
| 5,096,030 | A | 3/1992 | Espinosa |
| 5,105,920 | A | 4/1992 | Gtrebenstein |
| 5,109,961 | A | 5/1992 | Bergman |
| 5,207,303 | A | 5/1993 | Oswalt |
| D340,353 | S | 10/1993 | Benarrouch |
| 5,265,719 | A | 11/1993 | Wand |
| D347,729 | S | 6/1994 | Bible |
| 5,431,265 | A | 7/1995 | Yoo |
| 5,551,562 | A | 9/1996 | Beretta |
| 5,579,916 | A | 12/1996 | Manko |
| 5,676,223 | A | 10/1997 | Cunningham |
| 5,678,666 | A | 11/1997 | Shyr |
| 5,881,850 | A | 3/1999 | Murdoch |
| 6,000,509 | A | 12/1999 | Chisholm |
| 6,109,442 | A | 8/2000 | Roegner |
| 6,109,402 | A | 9/2000 | Godshaw |
| 6,148,971 | A | 11/2000 | Kho |
| 6,179,102 | B1 | 1/2001 | Weber |
| 6,234,287 | B1 | 5/2001 | Pfeiffer |
| D446,926 | S | 8/2001 | Silva |
| 6,336,460 | B2 | 1/2002 | Yuhara |
| 6,484,880 | B1 | 11/2002 | Schaeffer |
| 6,499,574 | B1 | 12/2002 | Anthony |
| 6,523,653 | B2 | 2/2003 | Roegner |
| 6,640,813 | B2 | 11/2003 | Raisner |
| 6,681,936 | B2 | 1/2004 | Godshaw |
| 6,848,581 | B2 | 2/2005 | Cohen |
| 6,910,560 | B2 | 6/2005 | Dulin |
| 6,935,133 | B2 | 8/2005 | Keeter |
| 6,976,566 | B1 | 12/2005 | Skriloff |
| 7,004,481 | B1 | 2/2006 | Stanish |
| 7,318,522 | B2 | 1/2008 | Adam |
| 7,584,841 | B2 | 9/2009 | Chan |
| 7,779,976 | B2 | 8/2010 | Mangano |
| 7,900,757 | B2 | 3/2011 | Sisitsky |
| 8,005,189 | B2 | 8/2011 | Ripp |
| 8,006,846 | B2 | 8/2011 | Robertson |
| 8,550,251 | B1 | 10/2013 | Ford |
| 8,596,458 | B1 | 12/2013 | Alcorn |
| 8,635,790 | B2 | 1/2014 | Goldberg |
| 9,554,631 | B1 * | 1/2017 | Bongiorno ..... A45C 5/03 |
| 2002/0153216 | A1 | 10/2002 | Krulik |
| 2005/0016808 | A1 | 1/2005 | Sapyta |
| 2005/0145458 | A1 | 7/2005 | Cohen |
| 2005/0218033 | A1 | 10/2005 | Curtis |
| 2007/0089954 | A1 | 4/2007 | Eardley |
| 2013/0020160 | A1 | 1/2013 | Mangano |
| 2013/0048456 | A1 | 2/2013 | Govor |
| 2013/0264162 | A1 | 10/2013 | Kogelnik |
| 2013/0277247 | A1 | 10/2013 | Caruth |
| 2013/0292220 | A1 | 11/2013 | Kerley |

* cited by examiner

TOILETRY ORGANIZER CASE/DISPLAY STAND FOR USE WITH A SUITCASE

CROSS-REFERENCE TO RELATED APPLICATIONS

This application is a continuation of U.S. application Ser. No. 14/297,407, filed on Jun. 5, 2014, all disclosures of which are incorporated herein by reference.

FIELD OF THE INVENTION

This invention relates to improvements in luggage, and more particularly to a specially constructed suitcase that enables easier packing of garments and other items therein, and better access to the items once packed.

BACKGROUND OF THE INVENTION

For many travelers, packing a suitcase is a chore even when necessary for a highly anticipated vacation, and it often seems like there is no effective way to stow all of the personal items needed for the tip, in the suitcase. There are many websites and guides that offer tips for how to efficiently pack a suitcase, but even for a traveler who has sought out and utilized such advice, once the suitcase is packed, subsequent access to particular articles of clothing or other items is thereafter limited, without digging and rifling through what is often a densely and neatly packed piece of luggage.

This is inconvenient if a traveler wishes to double-check, before leaving home, that a particular garment was actually packed. Furthermore, a similar problem is encountered when the traveler arrives at the destination. If the trip will be relatively brief, the traveler may not want to unpack all of the items from the suitcase into the dresser drawers in the hotel room, particularly if the person over-packed, and does not wish to have to repack everything at the time of departure. This situation is similarly encountered when visiting a relative and staying in a spare bedroom that has no dresser, or the dresser in the room is filled with the extra, out-of-season clothing of the homeowner-relative.

All of these issues with respect to packing and unpacking the suitcase are further compounded by the lack of a suitable place for, and ready access to, an extra pair of dress shoes and/or running shoes, and for all of the toiletry items that must be safely stowed and transported on the trip as well (e.g., blow dryer, shampoo, conditioner, mouth wash, shaving cream, tooth paste, etc.). Since there is no dedicated place for these items, there is a tendency for them to be squeezed, if not crushed, during the packing process, and during the subsequent baggage handling that the suitcase undergoes. It is not uncommon for the cap on these liquid and semi-liquid toiletry items to become loosened, leading to soiling of the traveler's clean clothing or just the interior of the suitcase. In addition, there is no adequately organized approach for both transporting of these toiletry items in the suitcase, and for then subsequently transferring them to the vanity in the hotel room, once the suitcase is placed on a luggage rack and opened. Furthermore, there is no suitable means for displaying and/or organizing the toiletry items on the vanity of a hotel room, where they may be protected against handling by housekeeping personal who tend to handle and move things around to clean the vanity, possibly while using unclean hands.

The easy access organizer suitcase of the present invention solves these problems of the prior art.

SUMMARY OF THE INVENTION

The suitcase of the present invention may include a base shell portion and a second shell portion (or just a cover) pivotally coupled thereto, and which may be latched using a latch means when closed. The base shell may include wheels and an extendable handle for rolling of the suitcase on the ground instead of it needing to be carried, as is typical on suitcases, and it may also include stops on the bottom of the base shell to complement the wheels, to help support the suitcase in a stable upright position.

A first partition may divide the second shell portion into first and second compartments. A second and a third partition may sub-divide the second compartment into first, second, and third sub-compartments, which may be suitably sized/configured to separately store two pairs of shoes, and a blow dryer therein. A flap that may be made of a transparent material may be used to releasably seal the shoes in the first and second sub-compartments using Velcro or other hook and loop type pieces of material. The flaps may serve to prevent any debris dislodged from the shoes from soiling the contents of the suitcase, and may eliminate the need for the traveler to place the shoes in a separate plastic bag. Fishnet may be used to secure the blow-dryer in the third sub-compartment, which may alternatively be used to store additional shoes or other items.

The interior of the first compartment may therein receive a case that may be formed to have a correspondingly shaped periphery, and be of a suitable depth. Alternatively, the size and shape of the case may be such that it may only occupy a portion of the first compartment, and may not extend to each of its sides, or even any of the sides of the periphery that defines the first compartment. The interior of the case may be partitioned to form a plurality of selectively shaped sub-compartments, each of which may receive correspondingly shaped toiletry and/or cosmetic items therein. A cover may seal the case, to provide protection for the garments in the suitcase against any possible leakage from the liquid and semi-liquid toiletry/cosmetic items stored within the case.

The case provides a safe and organized approach for both transporting of these toiletry items within the suitcase, and for then subsequently transferring them to the countertop of the vanity in a hotel room, all in one step. The cover may also be pivotally attached to the case, so that the cover may pivot, once unsealed, to a second position that permits the cover to support the case in an upright position, for convenient display and use of the toiletry items stored within the case when positioned upon the vanity countertop of a hotel room. Keeping the toiletry items within the display case on the vanity countertop provides hygienic protection against direct and unnecessary/undesired handling by hotel housekeeping personnel, who may be wearing gloves for cleaning of the bath tub, toilet, and sink, because such personnel may then just move the display case around, in order to clean the vanity, rather than touching and moving the traveler's individual toiletry items (e.g., the traveler's toothbrush, toothpaste, etc).

When the suitcase may be used to travel to visit a relative, and the suitcase may be placed on the floor of a guest room, it may be placed near a wall, such that when the second shell portion is pivoted open, it may be generally upright, but angled slightly so that its upper edge may rest against the wall. Thus, the flaps and the fishnet for securing/sealing of the first, second, and third sub-compartments may be positioned to provide selective access from an upwardly disposed side of the second shell portion that is distal from the hinge, which may be convenient for when the person kneels/bends down to retrieve the shoes or blow dryer from the suitcase sub-compartments.

DETAILED DESCRIPTION OF THE INVENTION

FIGS. 1-5 show orthogonal views of a first embodiment of the suitcase of the present invention. Suitcase 101 shown therein may include a base shell portion 10 and a second shell portion 20. The base shell portion 10 and the second shell portion 20 may be selectively attached together to permit the shell portions to pivotally move between the closed position shown in FIG. 1, in which an opening into the interior of each shell is opposed to and may cover the corresponding opening of the adjacent shell, and an open position, shown in FIG. 5. The base shell portion 10 and the second shell portion 20 may be pivotally attached using a strip of material that may flex. The strip of material may be sewn to both shell portions, or the strip of material may instead be formed integral therewith. The strip of material may appropriately flex to permit desired pivoting. Alternatively, one or more hinges may be used to permit the pivotal movement between the base shell portion 10 and the second shell portion 20. Merely to be illustrative within the Figures herein, three hinges 41 are shown for the suitcase 101.

Figure 3:
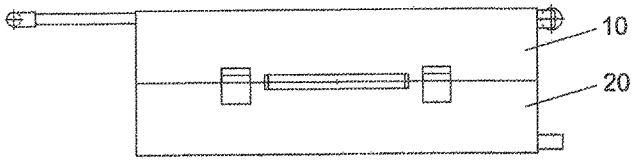
FIG. 3 is a second side view of the suitcase of FIG. 1.
Figure 1:
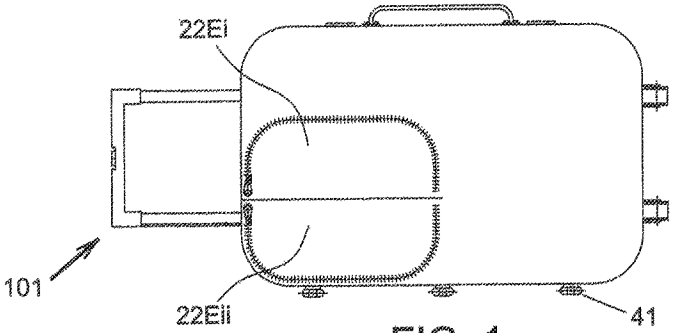
FIG. 1 is front view of a first embodiment of the suitcase of the present invention, shown in the closed position, where the second shell portion has been pivoted to be opposed to, and latched, with respect to the base shell portion.
Figure 2:
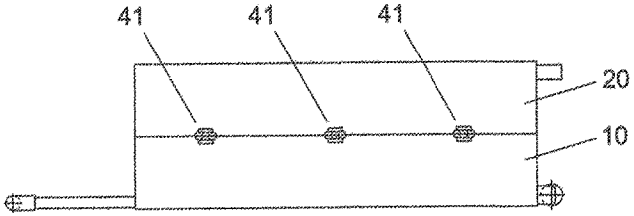
FIG. 2 is a first side view of the suitcase of FIG. 1.
Figure 4:
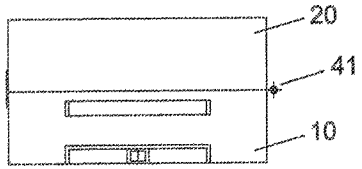
FIG. 4 is a top view of the suitcase of FIG. 1.
Figure 6:
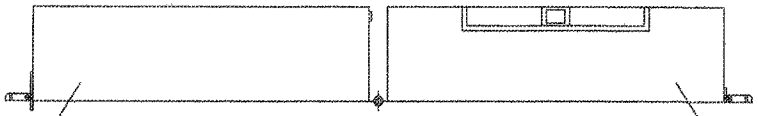
FIG. 6 is a top view of the suitcase shown in FIG. 5.

The base shell portion 10 and the second shell portion 20 of suitcase 101 may be latched in the closed position of FIGS. 1 and 3 using one or more suitable latches 42, such as the latch shown in U.S. Pat. No. 3,198,299 to Axtell, or in U.S. Pat. No. 3,034,327 to Garmon, or in U.S. Pat. No. 3,245,236 to Atkinson, or in U.S. Pat. No. 4,094,392 to Gregg, with the disclosures of each being incorporated herein by reference. Alternatively, the first and second shell portions may be secured to each other using a zipper, or other securement means (e.g., Velcro).

Figure 5:
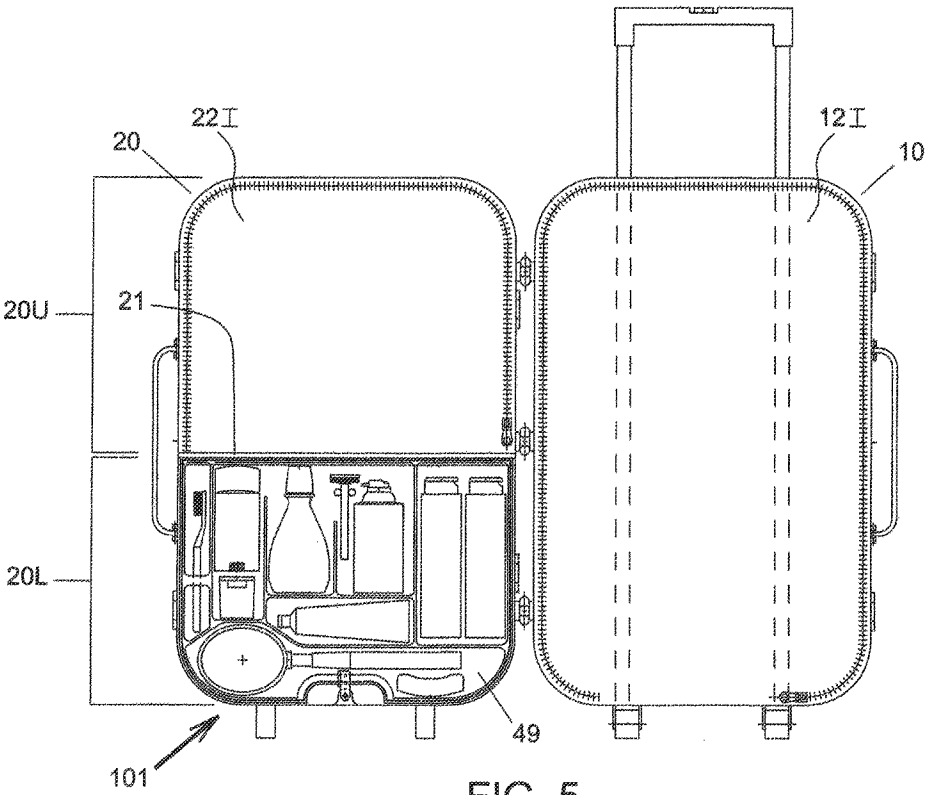
FIG. 5 is the front view of the suitcase as seen in FIG. 1, but shown with the second shell portion having been unlatched and pivoted 180 degrees away from the base shell portion, to be in an open position that exposes the interior of both the base shell and the second shell.
Figure 7A:
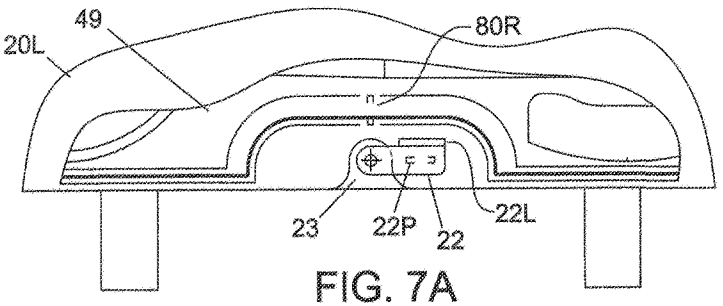
FIG. 7A is an enlarged detail view of the bottom of the suitcase of FIG. 5, showing the latch means for securing the case assembly within the lower compartment of the second shell portion having been moved to the unsecured position, and with the case assembly shown therein prior to its removal.
Figure 7:
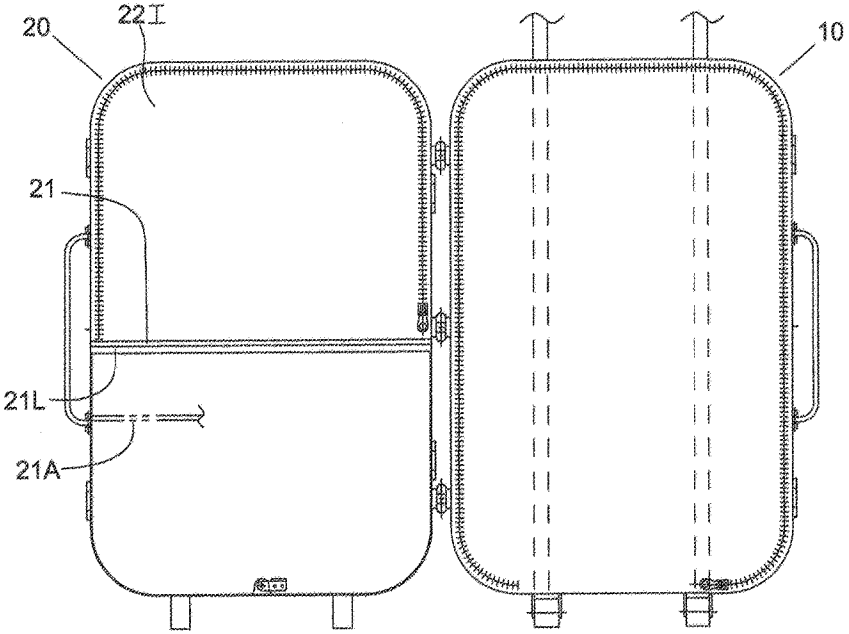
FIG. 7 is the front view of the suitcase as seen in FIG. 5, but shown with the latch for the toiletry case assembly having been moved into the unlatched position, and the case assembly having been removed from the second compartment of the second shell portion.

As seen in FIG. 5 and FIG. 7, the second shell portion 20 may have a partition 21 that may serve to divide the shell into an upper compartment 20U and a lower compartment 20L. The partition 21 may be a wall member that may be integrally formed with the shell portion 20, or the wall member may be a separate part that may instead be secured within the interior of the second shell portion in the proper position, using a means for releasably or fixedly securing the wall to the shell, such as adhesive, mechanically fasteners, welding, Velcro, etc., or a combination of the those means. The second shell portion 20 and partition 21 may also be configured so that the partition may be repositionable within the shell, which may permit the interchangeable use of two different sized case assemblies within the lower compartment 20L (e.g., case 49 shown in FIG. 9 and case 49A in FIG. 10), and is discussed further hereinafter.

The upper compartment 20U may be open, and without any means for positively retaining the traveler's garments therein. Alternatively, it may be advantageous to incorporate a flap 221 that may be secured to a portion of the upper compartment 20U, which may releasably cover the opening to the interior of the compartment, to facilitate ease in pivoting the second shell portion over the base shell portion, which may be resting upon the ground or on the traveler's bed while initially being packed. The flap 221 may be releasably secured to the second shell portion 20 using a zipper, or using Velcro (i.e., a hook material fixedly secured to the flap, which may be releasably secured to a loop material that is fixedly secured to the compartment of the second shell). The flap 221 may alternatively be releasably secured using snap fasteners (e.g., U.S. Pat. No. 3,975,803 to Katayama, the disclosures of which are incorporated herein by reference), or buttons, or any other suitable means of releasable securement.

To provide access to the upper compartment 20U from the exterior of the suitcase 101, when the base shell portion 10 and the second shell portion 20 may be latched in the closed position (see e.g., FIG. 1), one or more flaps may be incorporated into the exterior of the second shell portion. In FIG. 1, two flaps 22Ei and 22Eii are shown in a position which may correspond to shoe sub-compartments that are discussed hereinafter. Flaps 22Ei/22Ei may also be releasably secured using any of the above noted means. A flap 121 may similarly be used to releasably cover the opening into the interior of the base shell portion 10.

Figure 8B:
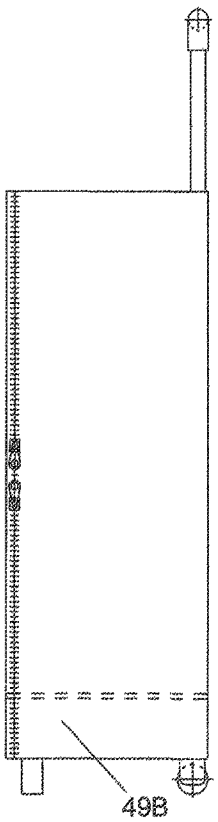
FIG. 8B is a side view of the suitcase embodiment of FIG. 8A, shown with the cover in a closed positioned, and secured thereat by a zipper.
Figure 8A:
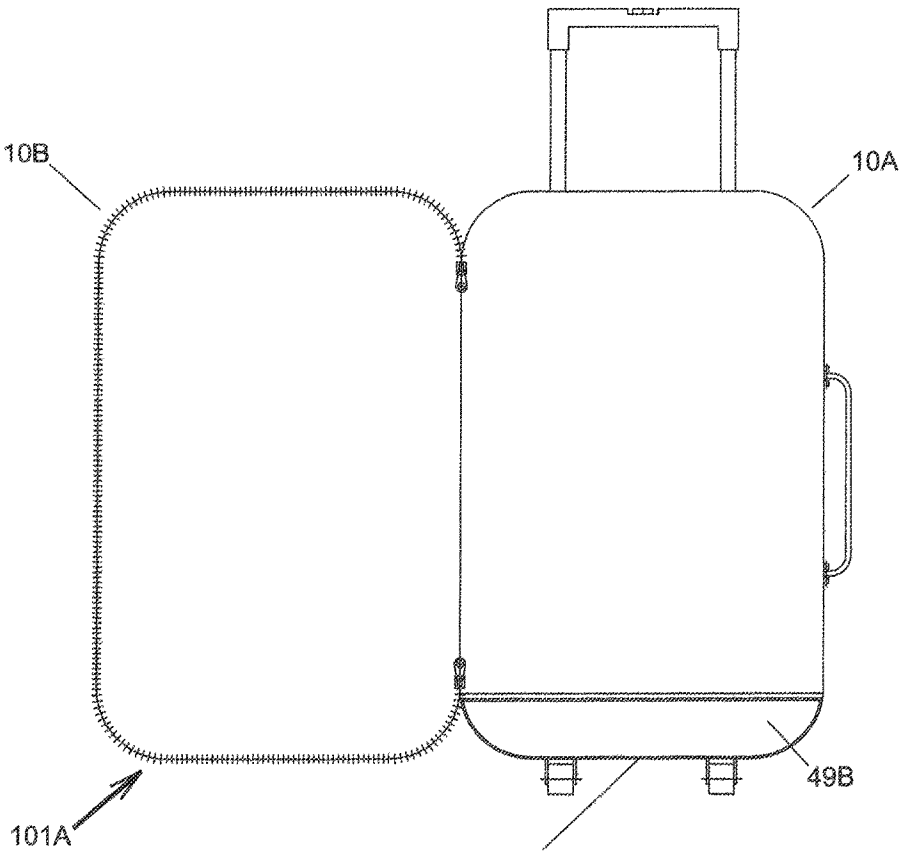
FIG. 8A shows an alternate embodiment of the suitcase of FIG. 5.

The lower compartment 20L may be adapted to releasably receive a specially configured case assembly 49 therein. The case assembly 49 is shown by itself within FIG. 9, after removal from the suitcase shown in FIG. 5, which may then appear as seen in FIG. 7. It should be noted that because of the density and weight of the items that may be carried within the case assembly 49 (e.g., shampoo, and other liquids/semi-liquids), it may be preferable for the case assembly to be adapted for transport within at least a portion of the lower compartment 20L rather than the upper compartment 20U, as it may offer greater stability for the suitcase 101 when being wheeled and otherwise handled by the user. Also note that for that same reason, the first shell 10 may instead be adapted to receive the case assembly 49 therein, so that it may be even closer to the wheels of the suitcase, for increased maneuverability and stability. This is shown by the suitcase embodiment 101A in FIG. 8A, which may include a base shell portion 10A with a corresponding cover 10B, where the base shell 10A may receive a correspondingly shaped case assembly 49B in a compartment therein. Case assembly 49B is shown in FIG. 10B.

The case assembly 49 may be adapted for ease of placement within, and removal from, the lower compartment 20L of suitcase 101 (FIG. 5). In one embodiment, the case assembly 49 may be formed to have its periphery correspond to the peripheral shape of the full extent of the lower compartment 20L (see FIG. 7), and may also be formed of a suitable depth (i.e., being equal to or somewhat less than the height of the compartment). A suitable clearance fit may be used between the exterior dimensions of the case assembly, and the interior dimension of the lower compartment 20L to accommodate such placement and removal. Alternatively, the size and shape of the case may be such that it may occupy only a portion of the compartment, and may not extend to each of the sides, or even to any of the sides of the periphery that defines the compartment.

In order to positively retain the case assembly within the lower compartment 20L, particularly when seeking to pivot the second shell portion 20 into a closed position with respect to the base shell portion 10, a lip 21L and a latch means may be incorporated into the lower compartment 20L of the second shell. Note that a protrusion protruding only from the sides of the shell portion itself may obviate the need for a partition with a lip thereon that spans the entire width of the shell, in which case the case assembly 49 itself may serve to partition the shell. In addition, the lip, partition, and latch means may also be replaced by magnets that may be used to retain the case assembly within the appropriate portion of the second shell 20. Where protrusions are used, each protrusion may be rectangular, or each protrusion may instead be a right angled protrusion, which may serve to both restrict sliding encroachment of the case assembly into the upper compartment 20U, and to prevent egress of one end of the case assembly out of the lower compartment 20L when used in combination with the latch means.

As seen in FIG. 7, the lip 21L may be formed to overhang the upstanding portion of the partition 21. When the user seeks to place the case assembly 49 into the lower compartment 20L, he/she may first insert the top 53 of the case therein, so that it may slide beneath the lip 21L into close proximity (or actual contact with) the partition 21. The user may next lower the bottom 54 of the case assembly into the lower compartment 20L, and may then secure the latch means. In this embodiment, the latch means in combination with the lip 21L may prevent egress of the case assembly out from the lower compartment 20L.

As seen in FIG. 7A, the latch means may take the form of a latch arm 22 that may be pivotally coupled to the second shell portion 20, by being pivotally coupled to a flange 23 that may protrude from the wall of the shell into its interior cavity. The flange 23 may be positioned at a height above the bottom of the second shell portion 20, so that the latch arm 22 may be able to rotate and not strike the case assembly, when it is placed within the lower compartment 20L. The latch arm 22 may have a small upstanding leg 22L that may better enable a person to grasp and actuate the latch arm, to move it from the unlatched position shown in FIG. 7A, to the latched position shown in FIG. 5.

To maintain the latch arm 22 in the latched position of FIG. 5, the pivotal connection between the latch arm and the flange 23 may have a friction fit therebetween to prevent inadvertent movement of the latch arm, until a sufficient force is applied by the user. Instead of using a friction fit, a small protrusion 22P on the bottom of the flange 22 may releasably engage a small corresponding recess 80R on a portion of the case assembly 49, and may serve as a detent. The protrusion 22P and the recess 80R may each be elongated in shape. Therefore, to provide suitable engagement as a detent, the height of the case assembly 49, the positioning of the flange 23 above the bottom of the lower compartment 20L, and the extent of the protrusion 22P on the bottom of the flange may be appropriately coordinated.

The case assembly 49 may include a case 50, a cover 70, and a means for releasably securing and sealing the cover over an opening into the interior of the case, when in a closed position, to prevent leakage of shampoo or other fluids therefrom. The means for releasably securing/sealing the cover upon the opening of the case may also functionally serve to reconfigure the case assembly to provide support, when in an open position, to position the case at a suitable viewing angle for display of the interior of the case, which may be a position between a substantially upright (vertical) position, and a horizontal position.

Figure 12:
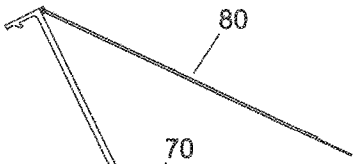
FIG. 12 shows the side view of the case assembly of FIG. 11, but is shown with the cover and cover support arm pivoted away from the closed position, and with the display arm pivoted away from its stowed position with respect to the cover.
Figure 12:
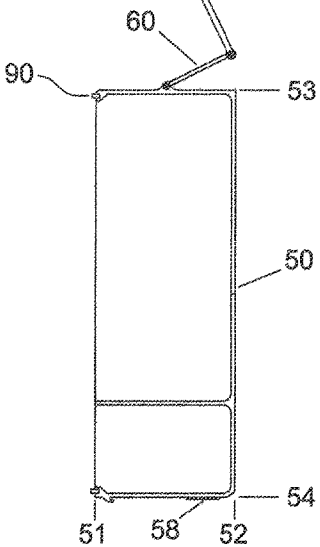

The case 50 may be formed as a single unitary wall, and into a shape that generally matches the interior of the lower compartment 20L. Alternatively, separate walls may be assembled and fixedly joined to form the case. As seen in FIG. 12, the wall or walls of the case may have a first side 51 that may create an opening into an interior cavity of the case, and a second side 52 that may be generally flat and may be intended to sit flush upon the bottom of the lower compartment 20L of the second shell portion 20.

The case 50 and the cover 70 may be configured to be complementary and of a suitable elastomeric material, so that the engagement therebetween may itself serve as a means for sealing the case assembly against leakage. Alternatively, where a more durable and harder plastic material may be used for the case and/or the cover (e.g., ABS plastic), the periphery about the opening in the first side 51 of the case 50 may have a groove 53 that may be configured to receive a separate seal member 90 therein. The seal member 90 may be of sufficient height so that it may normally protrude out from the groove 53. The seal member 90 may be made of an elastomeric material. It may furthermore be made of a food grade or a medical grade elastomer. The seal member 90 may be a continuous member without a beginning or an end, or it may have two ends which may be positioned in contact with each other when placed within the groove 53. The ends of seal 90 may be bonded together therein to form a seal of greater integrity.

The top 53 of the case 50 may be generally flat (FIGS. 9 and 12), as it may be intended to be positioned in close proximity to the partition 21, and the sides 55/56 of the case may each have a respective curved transition 55T/56T to the bottom 54 of the case, which may be so formed to match the side periphery of the second shell portion 20 of the suitcase 101. A recess 54R in the bottom 54 of the case 50 (FIG. 9) may be used to facilitate easy grasping of the case by the user, when it is desired to remove the case from the form-fitting interior of the lower compartment 20L.

Figure 10A:
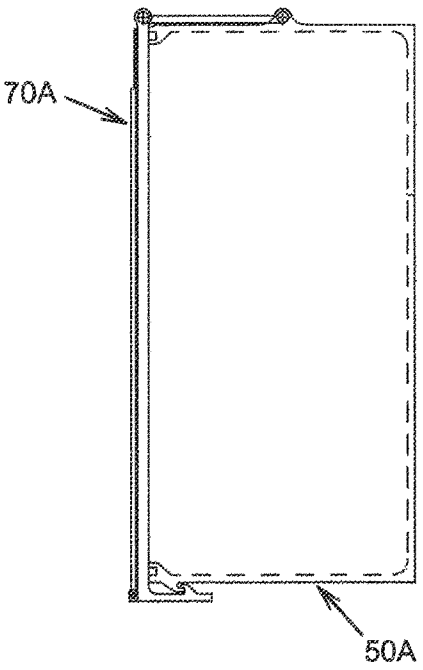
FIG. 10A is a side view of the case assembly of FIG. 10.

The case may be formed without any interior walls (e.g., case 50A for case assembly 49A in FIGS. 10 and 10A), and the user may freely and compactly place any needed toiletry items therein, to be sealed and safely transported by the case assembly, within the suitcase 101. This may serve to better optimize use of the volume within the case assembly, and the suitcase as well.

Alternatively, the case 50, which may be an injection molded plastic part, may be so formed with a plurality of interior walls 55A, 55B, 55C, etc., to create a plurality of partitions to form a plurality of selectively shaped sub-compartments.

Figure 9A:
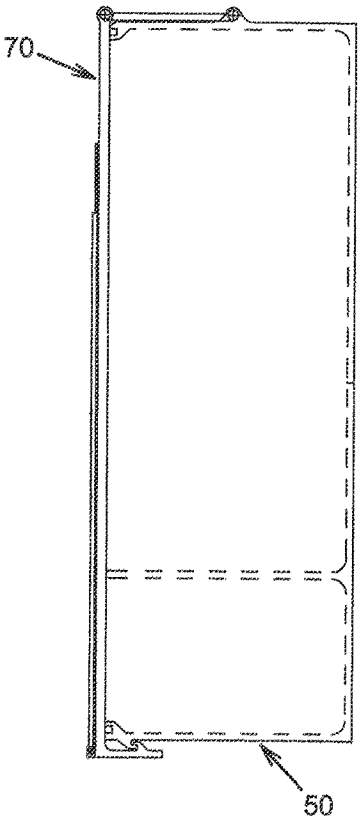
FIG. 9A is a side view of the case assembly of FIG. 9.
Figure 9:
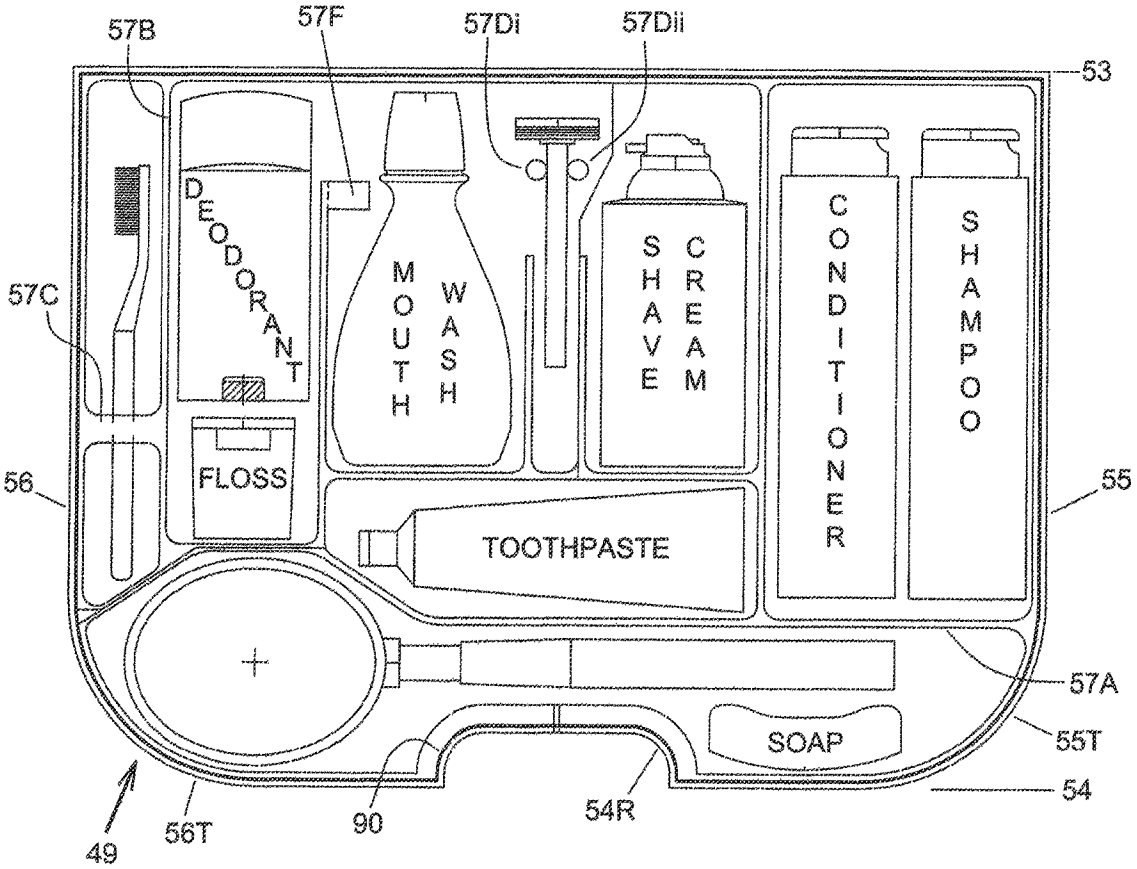
FIG. 9 is a front view of the case assembly, after its removal from the second compartment of the second shell portion of the suitcase of FIG. 5.

Each of the selectively shaped sub-compartments of case 50 may be particularly configured to respectively receive a correspondingly shaped toiletry item therein, as seen in FIG. 9. The sub-compartments may thus be generally shaped to store correspondingly shaped toiletry items that a traveler will likely need and desire to take on a trip, such as shampoo, conditioner, shaving cream, mouth wash, toothpasth, a tooth brush, deodorant, dental floss, a back scrub brush, a bar of a specialty soap, a razor, etc. Note that the arrangement of toiletry items within case assembly 49 and its integrally formed walls, as seen in FIG. 9, may also be rearranged to better optimize the use of the space therein, and to reduce the size/volume necessary to contain such items, however, such rearrangement may tend to diminish the ready accessibility/visibility of the items within the display case when placed upon the vanity countertop.

Figure 10:
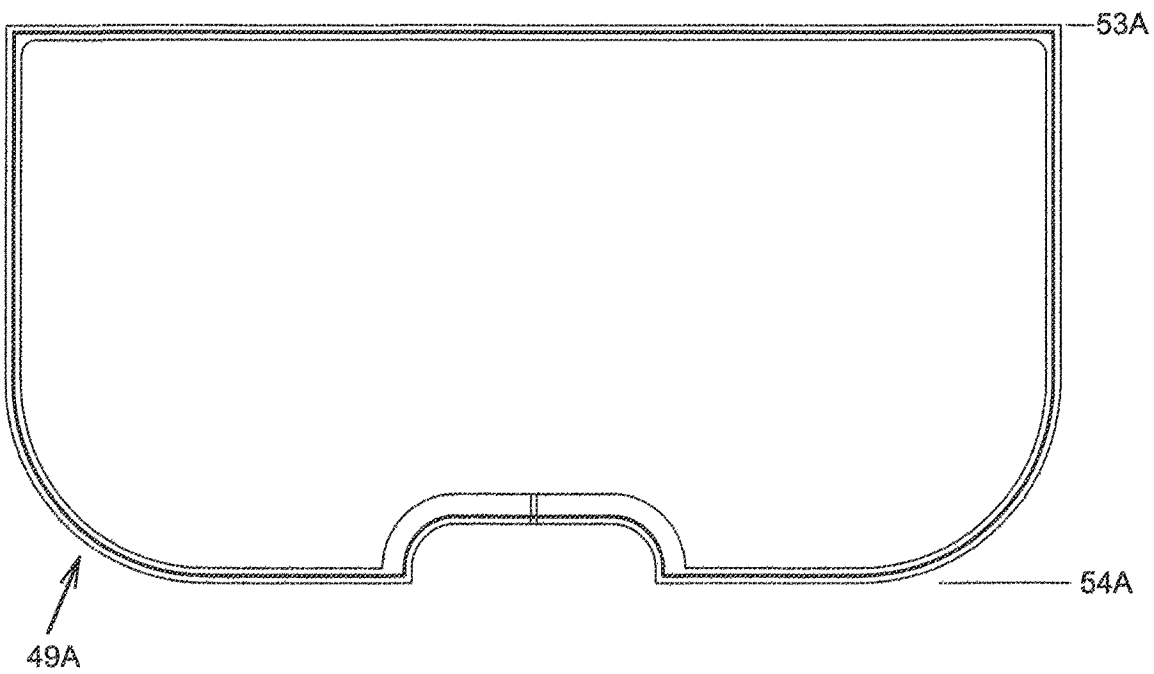
FIG. 10 is a front view of an alternate embodiment of the case assembly of FIG. 9, with the case and cover being reduced in height, and with the case being formed without any integral stiffeners (sub-compartments) therein.
Figure 10C:
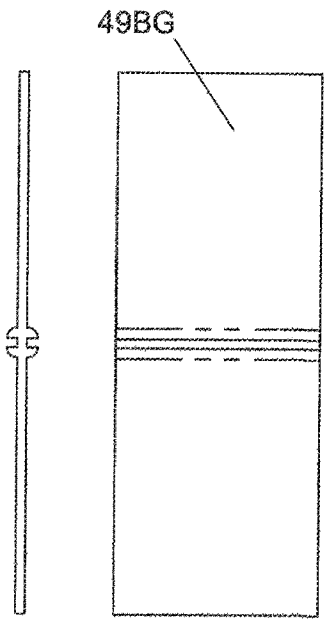
FIG. 10C shows a front view and a side view of a partition member that may be used in the case assembly of FIG. 10B.
Figure 10B:
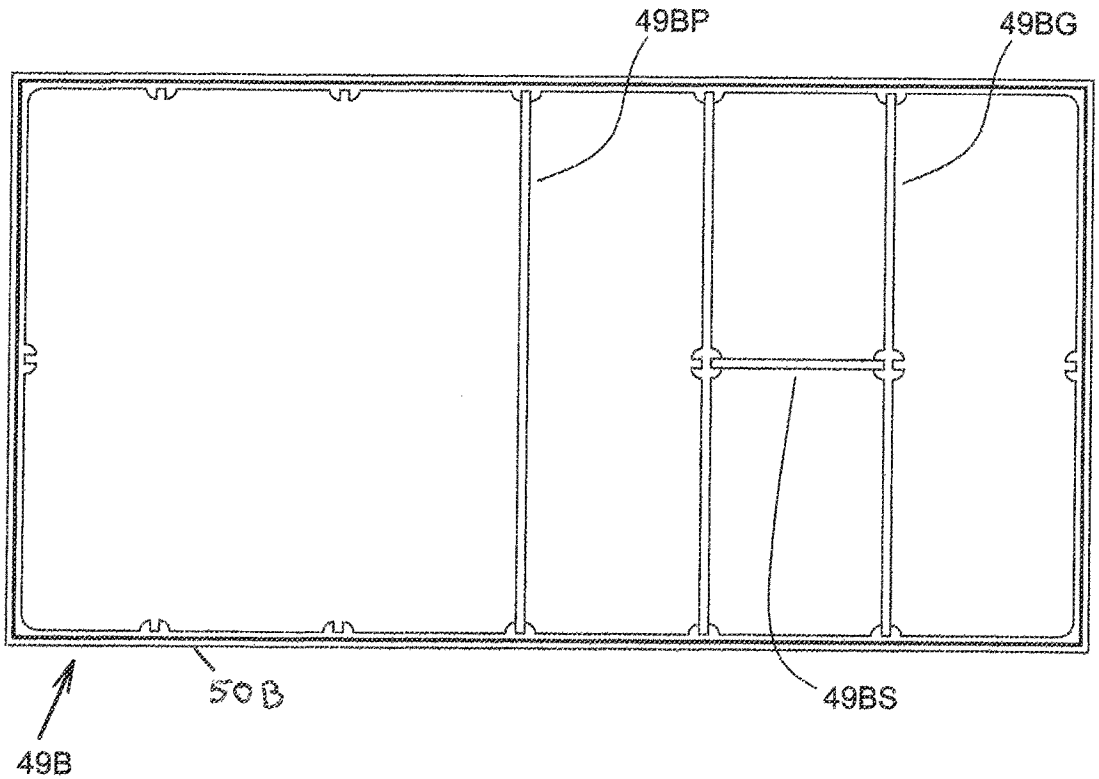
FIG. 10B is a front view of an alternate embodiment of the case assembly of FIG. 10, being configured to releasably receive modular partition members therein.

The case assembly 49B shown in FIG. 10B may be similar to the case assembly 49A in FIG. 10, except that its case 50B may include grooves that may receive modular partition members 49BP, so that the traveler may create custom sub-compartments in the interior of the case to suit the particular toiletry items that may be needed for a trip. A partition member 49BG, which is shown in detail within FIG. 9D, may additionally or alternatively be utilized, and may have central grooves that may receive short-transverse partition members 49BS. Note that these grooves in the case 50B may similarly be used in the second shell portion 20 to releasably receive the partition member 21, which may permit the hereinabove described repositioning of the partition member to reconfigured the lower compartment to receive either case assembly 49 or the reduced height case assembly 49A therein.

The integrally formed sub-compartments of case 50 used for case assembly 49 may also be highly tailored to receive a particular item, such as, for example, the addition of a wall 57C to the case (FIG. 9), which may serve to create a toothbrush stand/holder, to retain the toothbrush therein in an upright and supported position. Also, for example, a pair of posts 57Di/57Dii may protrude outward from the interior of the second side 52 of the case 50 to provide releasable support for a traveler's razor. Other interior walls may be included merely to provide a restraint against undesired movement of the toiletry items contained therein.

Figure 9B:
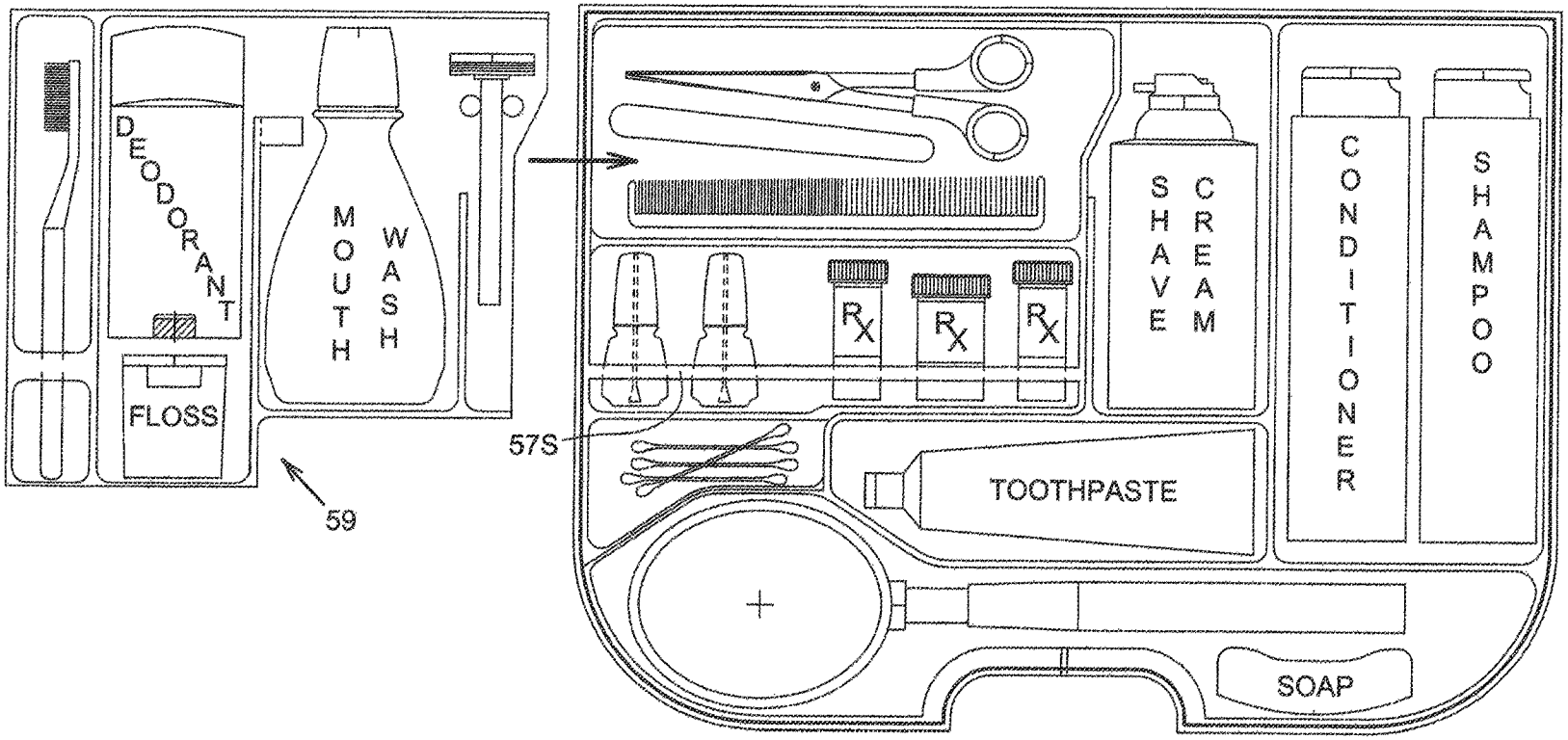
FIG. 9B is an exploded view of the case assembly of FIG. 9, showing the removable tray positioned beside the case to reveal lower sub-compartments.

As seen in FIG. 9, for that portion of the case that may store the shallower depth toiletry items, such as for the tooth brush, dental floss, deodorant, and mouth wash, the case may be thereat be constructed to receive a small separable tray 59 to hold those items, and the tray may be removable from the case 50, as seen in FIG. 9B. A stiffener of the tray 59 may transition into a finger grip 57F (FIG. 9), to provide a means for easy removal of the tray from the remainder of the case. Removal of the separable tray 59 may expose additional shallower depth walls that may form additional sub-compartments that may be usable for the storage of cotton swabs or cotton balls. Other walls may create a sub-compartment beneath the tray that may form of a rack that may be sized and shaped to retain the traveler's prescription pill bottles, or possibly nail polish containers. An elastic strap 57S may be secured to the case walls to stretch across a portion of the rack (or alternatively, an integral stiffener may be formed thereat), to provide for retention of the pill bottles and nail polish container. Another sub-compartment therein may form an open area that may be suitable for storing scissors, a comb, emery boards, etc.

In one embodiment, the tray 59 may simply be a separate part that is completely removable from the case 50. The back of the separate tray 59 may have a plastic arm pivotally secured thereto (see FIG. 18), similar to that of a picture frame, to permit the tray to stand generally in an upright position on a vanity countertop, in which case the bottom of the tray may preferably not have a step therein. Alternatively, in another embodiment, a portion of the tray 59 (e.g., the top of the tray) may be pivotally secured to the top 53 of the case 50, so that it may pivot to expose the lower compartments therein.

Figure 11B:
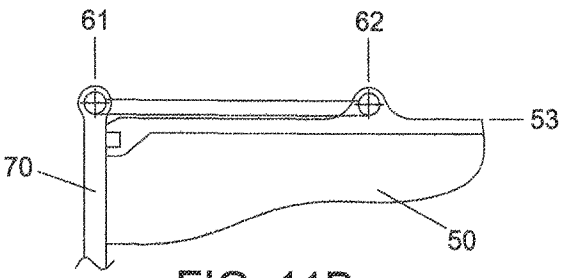
FIG. 11B is an enlarged detail view of the top of the case assembly of FIG. 11, showing the pivotal coupling of the cover to the cover support arm, and the pivotal coupling of the cover support arm to the top of the case.
Figure 11A:
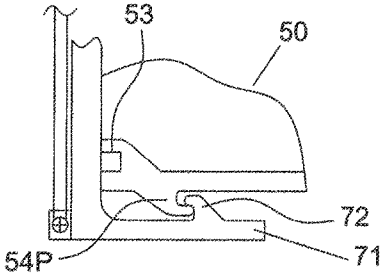
FIG. 11A is an enlarged detail view of the bottom of the case assembly of FIG. 11, showing the engagement of a portion of the cover with a portion of the case.

To secure the case 50 against leakage, the cover 70 may be configured to enclose and seal the opening in the first side 51 of the case, to secure the interior cavity and sub-compartments therein. The cover 70, which may be formed of a translucent plastic material, may have a protrusion 72 extending from a flange on each side of the cover, each of which may engage a corresponding protrusion on the periphery of the case 50, similar to plastic food containers, such as Tupperware. Alternatively, the cover 70 may be pivotally supported at its upper end, and when the cover is pivoted into a closed position to engage and seal against the opening, or to compress and seal against the seal member 90, it may be releasably secured thereat by a protrusion 72 extending from a flange 71 on cover 70 that may engage a corresponding protrusion 54P on the bottom 54 of the case 50, as seen in FIG. 11A. The protrusions 72 and 54P may take on different shapes, and are shown exaggerated in form merely to be illustrative within FIG. 11A.

Figure 13:
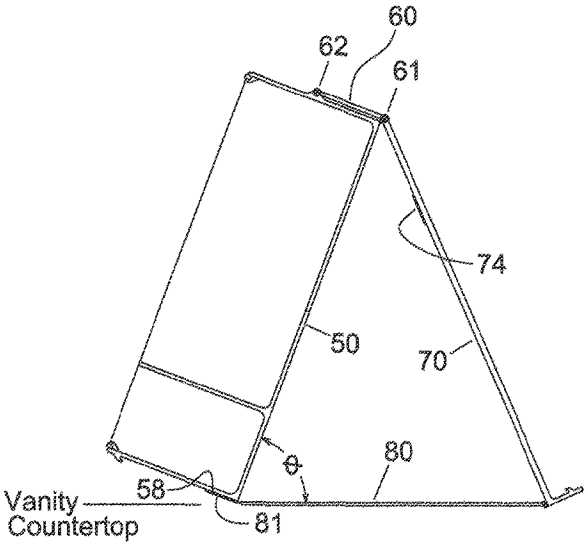
FIG. 13 shows the side view of the case assembly of FIG. 12, but with the cover and the display arm pivoted into a first display position, in which a portion of the display arm is engaged with a bottom portion of the case, to support the case at an acute angle with respect to vertical.
Figure 13A:
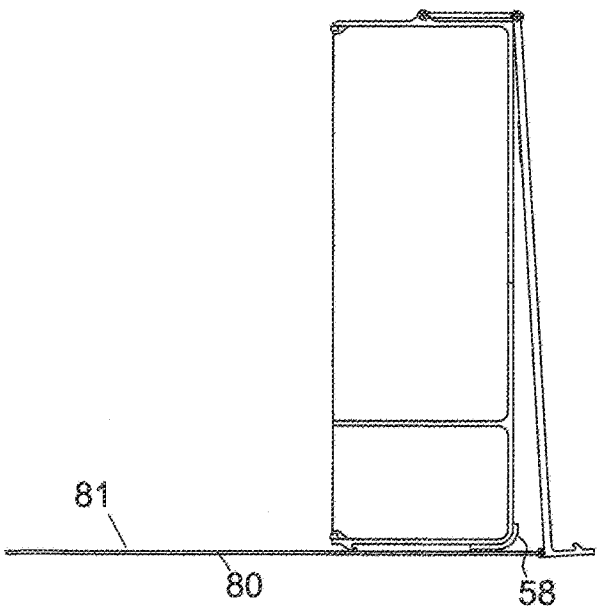
FIG. 13A shows the side view of FIG. 13, but with an alternate embodiment for the Velcro on the display arm, and with the cover and the display arm pivoted into a display position in which the case is nearly vertical.
Figure 13B:
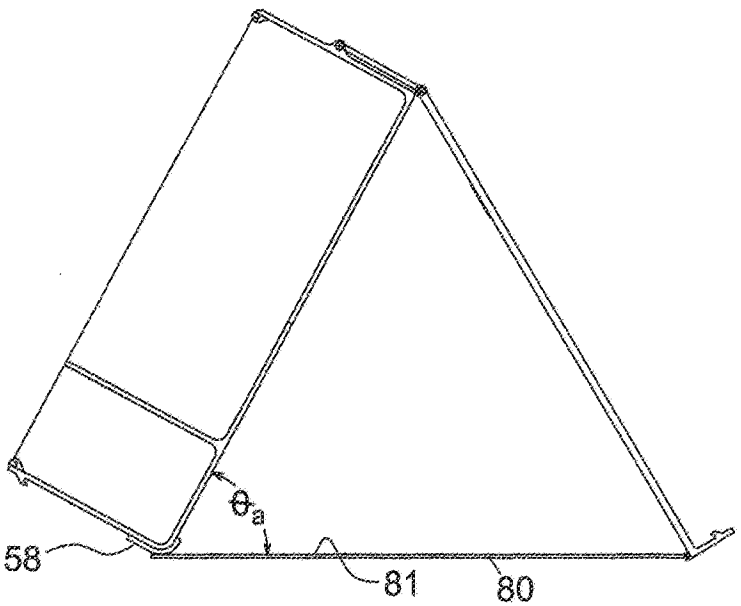
FIG. 13B shows the side view of FIG. 13A, but with the cover and the display arm pivoted into a display position in which the case is at roughly a 60 degree angle with the vanity countertop.
Figure 13C:
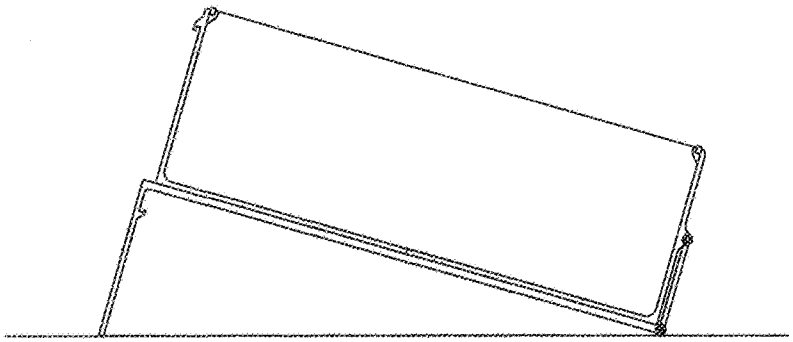
FIG. 13C shows a side view of the case assetibly of FIG. 10, but with the cover and the display arm pivoted into an alternate display position, and with the flange on the cover shown to be extended in length.

To permit the cover 70 to additionally function to provide support for the case 50, so that it may occupy an open position that is particularly oriented for display of the interior of the case, a special hinge arrangement for the cover may be utilized. A cover support arm 60 (FIGS. 11B and 12) may have a first end 61 be pivotally coupled to the cover 70, and a second end 62 may be pivotally coupled to the top 53 of the case 50 between its first and second sides (51 and 52), to permit pivotal movement of the cover from a closed position to one or more open positions. A first possible open position is shown in FIG. 13C, in which the cover 70 may be pivoted 180 degrees so that it may be in contact with the second side 52 of the case 50, with the flange 71 supporting the case in an angled display position. In this example, flange 71 of cover 70 may extend to be a little longer, so that the display angle may be less acute.

Figure 11:
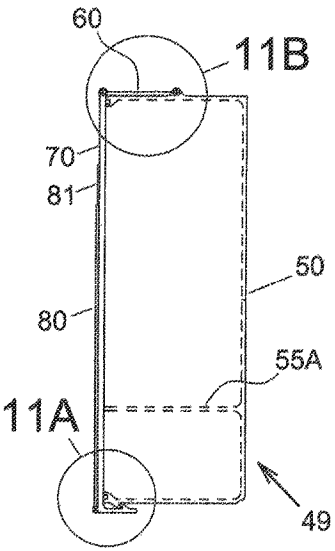
FIG. 11 is the side view of FIG. 9A, but shown reduced in size.

To provide support for the case 50 to be at a display angle that may preferably be more upright (closer to a vertical orientation), and which may also be adjusted according to the person's subsequent preference, a different arrangement for the cover 70 may be utilized. The cover 70 may therefore also include a display arm 80 (FIG. 11) that may have one end be pivotally coupled to the bottom of the cover. When the cover 70 is unsecured from its closed/sealed position with respect to the first side 51 of case 50 and is pivoted therefrom, as seen in FIG. 12, the upper end of the display arm 80 may be pivoted away from proximity to/contact with the cover. As seen in FIG. 13, the display arm may support the case 50 in a desired upright display position, through its engagement with the bottom corner of the case at its second side 52.

To prevent the case 50 from sliding relative to display arm 80 and to prevent the stand arrangement seen in FIG. 13 from collapsing, several different means of engagement between the bottom (or the bottom corner) of the case and the display arm 80 may be used. Such sliding may be prevented simply by the weight of the loaded display case resting upon and contacting the display arm 80, with the coefficient of friction therebetween being sufficient to inhibit sliding movement. In one embodiment, both the display arm 80 and a portion of the corner of the case may be made of a slip-resistant (e.g., rubberized) material, or may have a suitable coating thereon (e.g., a rubber coating) that may increase the coefficient of sliding friction therebetween.

Figure 15A:
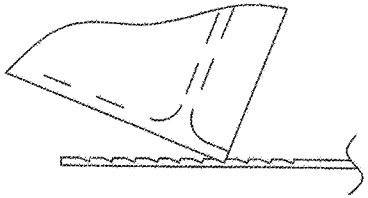
FIG. 15A is an enlarged detail view of the case assembly of FIG. 15, showing the corner of the case engaging within an elongated groove in the display arm, to support the case at a desired display position.

In another embodiment, the display arm 80 may have a single lip at its end, or it may have a series of V-shaped grooves extending laterally across the extent of the arm (e.g., into/out from the page, as seen in FIG. 15A), which may be configured to receive a corner of the case therein to prevent such sliding. The display arm 80 may extend a sufficient distance to peimit retention of the corner of the case 50 within a suitable grove that provides support for the case at a desired display angle.

In yet another embodiment, Velcro may be used to secure the display arm 80 to the case bottom 54, as seen in FIG. 13. A piece of hook material and a piece of loop material (81 and 58) may each be secured to either one of the display arm 80 and the case 50. The length of the Velcro piece 81 on the display arm 80 may be sufficiently long to permit various adjustments to the display angle θ seen in FIG. 13. In another alternate embodiment, a significant portion of the length of the display arm 80 may have a piece of Velcro (hook material) 81 fixedly secured thereto, and the bottom of the case may have a corresponding piece of Velcro (loop material) fixedly secured thereto (58), to permit a range of display positions for the case, as seen in FIG. 13A which shows a substantially vertical position, and as seen in FIG. 13B, where the case is roughly at a 60 degree angle with the vanity countertop.

The display arm 80 may be free to pivot with respect to the cover 70. Alternatively, a friction fit may be used at the pivotal connection therebetween, to limit such freedom of movement when in the stowed position of FIG. 11. In another alternative embodiment, a Velcro piece 74 may be fixedly secured to the cover 70, which may be releasably secured to a corresponding Velcro piece 81 on the display arm 80, when the display arm is moved into the stowed position of FIG. 11.

The length of the cover support arm 60 is significant, and to provide stability to the case 50 when in the display position of FIG. 13, it should be chosen so that the first end 61 of the arm is in close proximity to the second side 52 of case 50. If the length of the arm 60 is significantly greater, the case 50, the cover support arm 60, the cover 70, and the display arm 80 may form a four bar linkage, and a secure display position for the case will not be assured. With the length of the cover support arm 60 formed so that its first end 61 may be pivoted to be in close proximity to the second side 52 of case 50, as seen in FIG. 13, the case 50, the cover 70 and the display arm 80 may form a triangular shape that provides stable support for the case, in a desired display position. In addition, it should be noted that the pivotal connection between the second end 62 of the cover support arm 60 and the top 53 of the case 50 is preferably proximate to a midpoint between the first and second sides (51 and 52) of the case.

Figure 15:
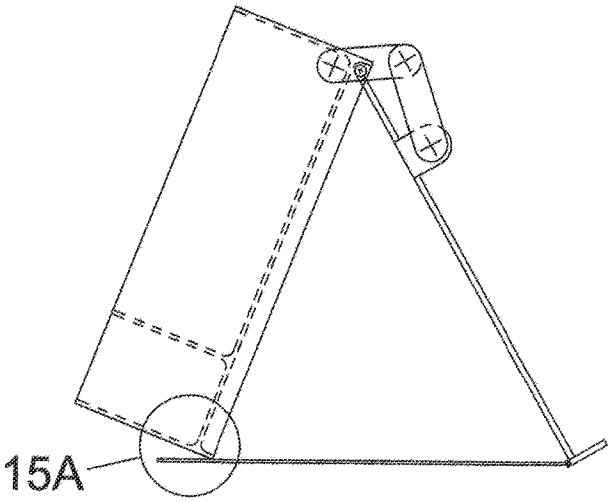
FIG. 15 is the case assembly of FIG. 14 shown with the cover supporting the case in an upright position on a vanity countertop, with the top of the cover engaging a lip at the top of the back of the case.
Figure 14:
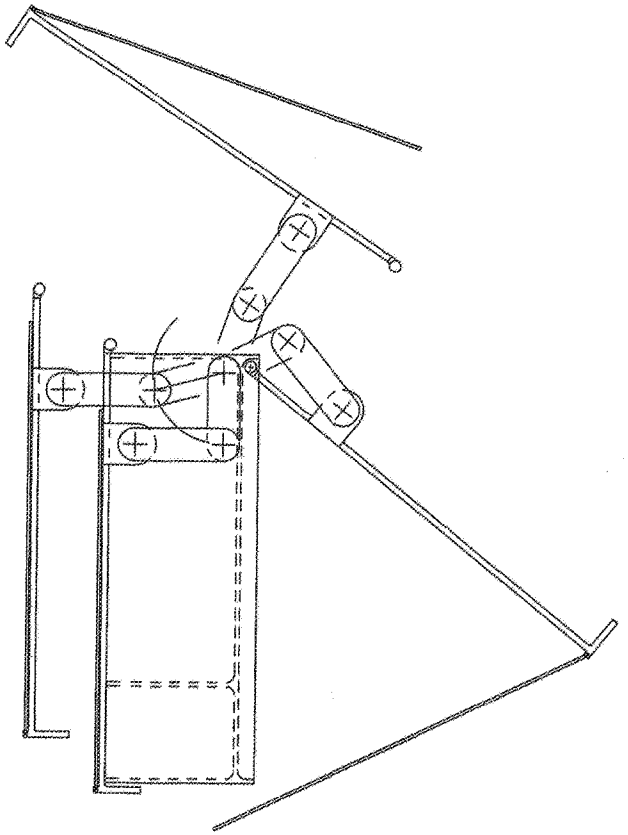
FIG. 14 shows a side view of another alternate embodiment of the case assembly, showing the cover of the case assembly transitioning, using two pairs of arms, from a closed position into several open positions, one of which may support the case in an upright position.

An alternative means for supporting the case in an upright position is shown by the embodiment within FIGS. 14-15, in which the cover may be supported at each end by a pair of arms that may permit translating and pivoting of the cover. In the display position, the top of the cover may be retained within a recess at the top of the back of the case, and the display arm may be engaged with the bottom of the case, as discussed hereinabove.

Figure 17:
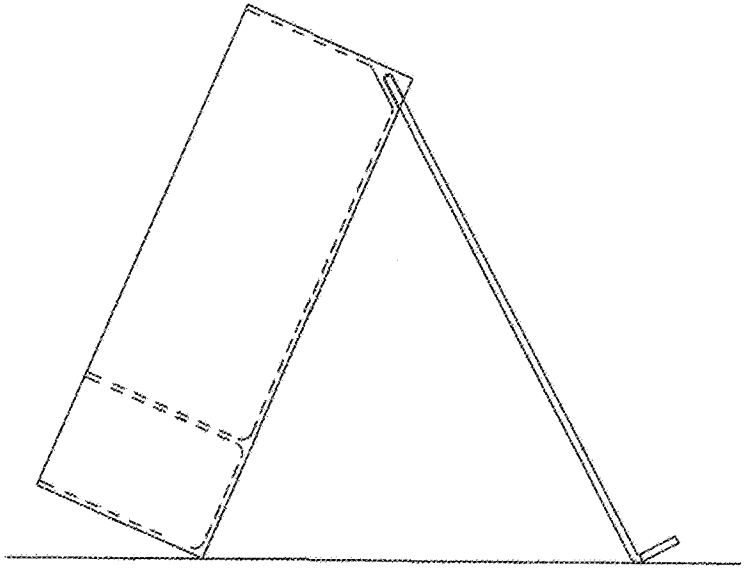
FIG. 17 is the case assembly of FIG. 16, shown with the cover supporting the case in an upright position on a vanity countertop.
Figure 16:
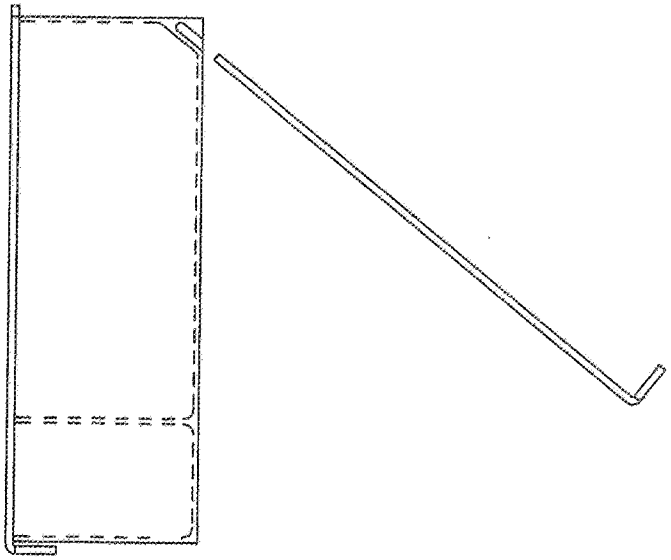
FIG. 16 a side view of another alternate embodiment of the case assembly, in which the cover is not pivotally coupled to the case, but may nonetheless support the case in an upright display position, by having a portion of the top of the cover be received within a recess at the back of the case.

Another alternative embodiment is shown within FIGS. 16-17, in which the cover is not pivotally attached to the case. In this embodiment, the cover may be removed from engagement over the opening of the case, and have an end be received within a corresponding recess at the back of the case, to provide support for a singular display position.

Figure 20:
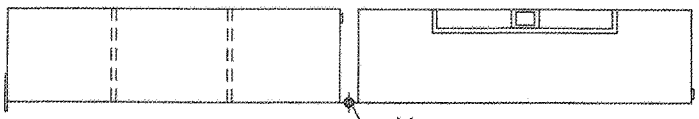
FIG. 20 is a top view of the suitcase of FIG. 19.
Figure 19:
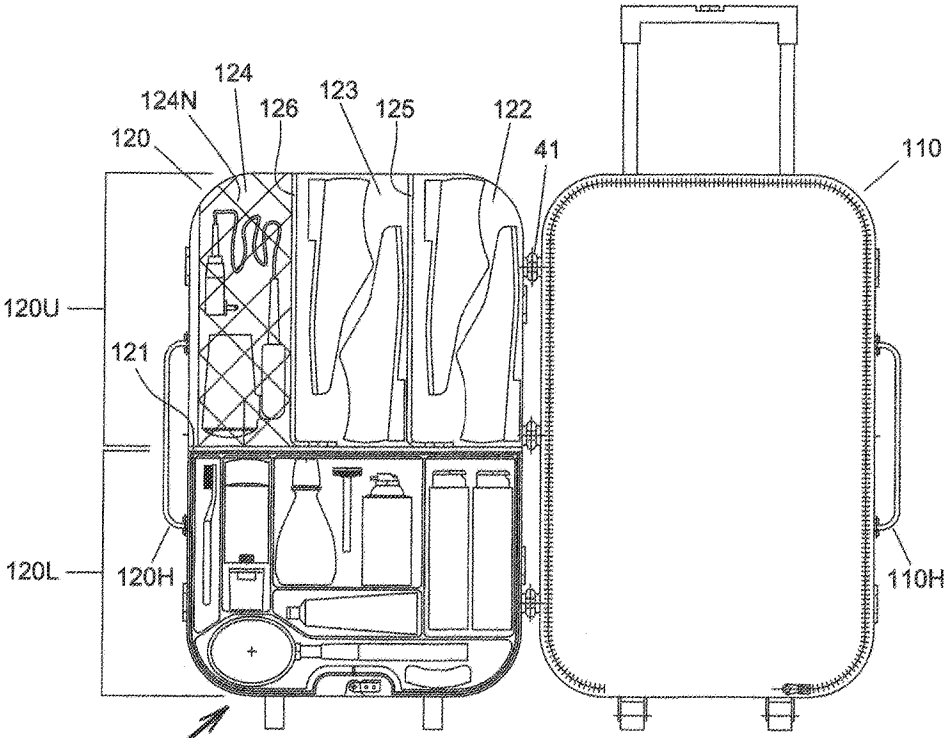
FIG. 19 shows an alternate embodiment of the suitcase of FIG. 5, in which partitioning of the upper compartment of the second shell may form sub-compartments that may be configured to receive extra pairs of shoes and/or a blow dryer.

Further improvements according to another suitcase embodiment of the present invention may be seen for suitcase 102, which is shown within FIGS. 19-20, and which solves other organization problems with respect to the items in the traveler's suitcase. Two such problems relate to efficiently carrying extra pairs of shoes and a bulky blow dryer therein, and of accessing the items within the suitcase once the traveler is at the destination and the suitcase is opened. Quite often, a traveler will merely be driving or flying to another city, state, or country to visit and stay with relatives, and usually will be staying in a guest room that has an extra bed or a sleeper sofa. However, there is usually no place into which the traveler's items within the suitcase may be unpacked (i.e., no empty dresser drawers and no open closet space in the "guest" room). Therefore, the traveler is forced to live out of his/her suitcase, which is invariably placed on the floor, and he or she must necessarily use a bathroom that is located down the hall or in another part of the home.

Suitcase 102 is constructed so that in addition to providing a means of easily and conveniently transporting all of the necessary toiletry items, using case assembly 49, to such a remote bathroom each time, and of being able to conveniently display those items similar to its accessibility within the traveler's own medicine cabinet in their own home, it may furthermore lessen the disorganization therein and the need to rummage through the entire suitcase, by providing a dedicated place for the traveler's extra pairs of shoes (running shoes, casual shoes, and/or dress shoes . . . ) and/or for a blow dryer.

Figure 21A:
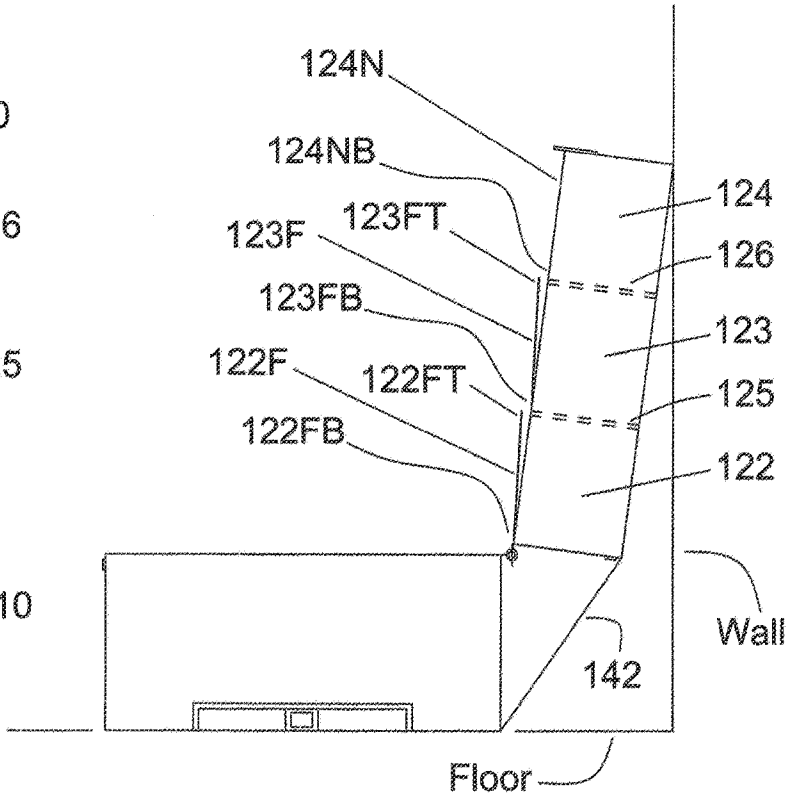
FIG. 21A is a side view of the suitcase of FIG. 21.
Figure 21:
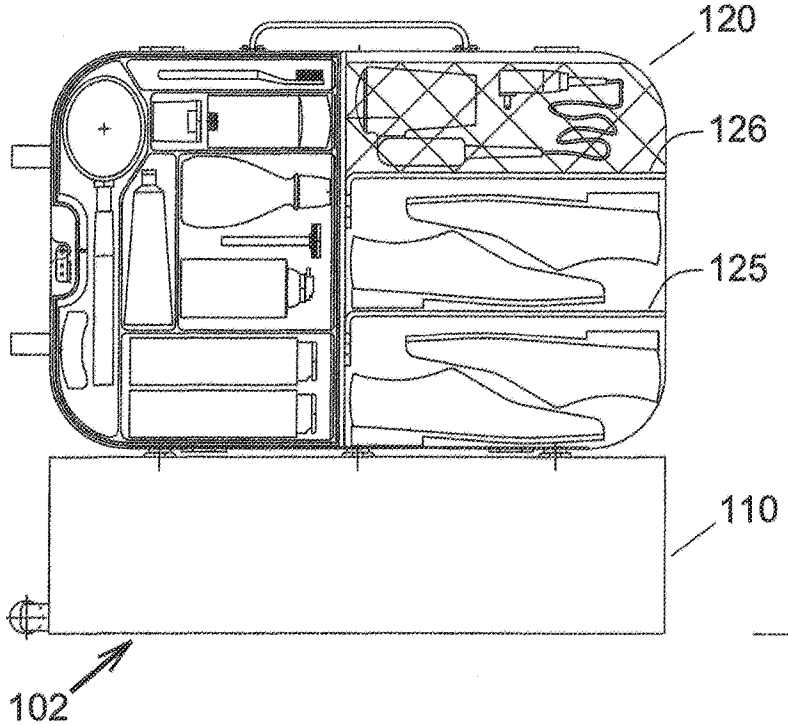
FIG. 21 shows the suitcase of FIG. 19 having been opened upon a floor of a guest room, with the second shell portion propped up against the wall.
Figure 22A:
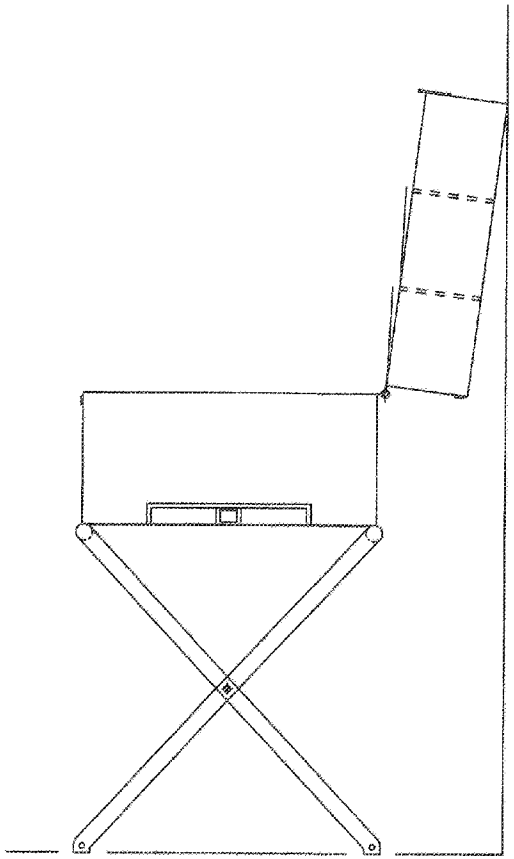
FIG. 22A is a side view of the suitcase of FIG. 22.
Figure 22:
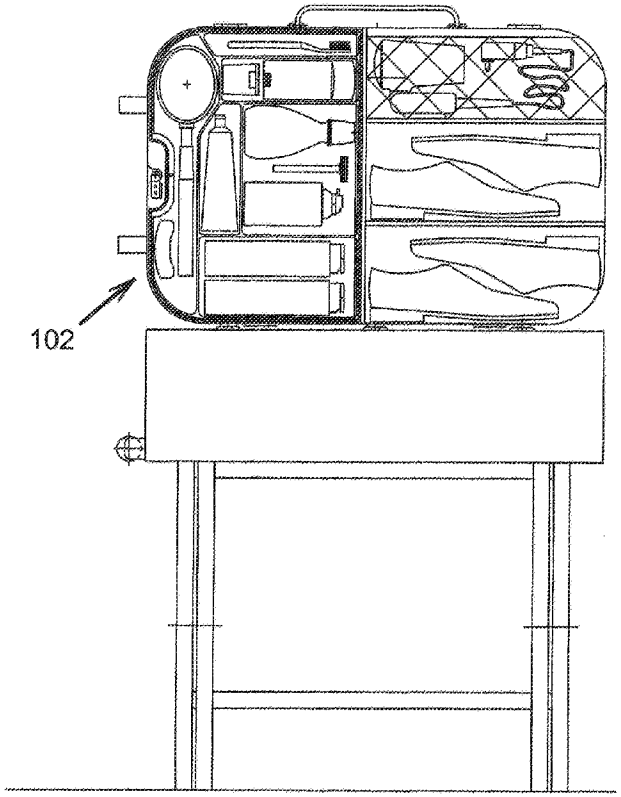
FIG. 22 shows the suitcase of FIG. 19 having been opened upon a hotel luggage rack, with the second shell portion propped up against the wall.

Suitcase 102 may be constructed the same as suitcase 101 shown within FIG. 5, but in addition, the upper compartment 120U may itself be subdivided. The second shell portion 120 may be particularly subdivided into sub-compartments that may be conveniently accessed when the first shell portion 110 is positioned on the floor of the guest room, and the second shell portion may be opened and leaning against the wall, to occupy less floor space while providing greater access to the contents, as seen in FIGS. 21-21A. The suitcase 102 may also be similarly positioned and accessed when resting upon the luggage rack pictured within FIG. 18, and which is also shown in FIGS. 22-22A.

The upper compartment 120U may thus be further subdivided to include a partition 125 and partition 126, which may be oriented to be orthogonal to partition 121, to create sub-compartments 122, 123, and 124. Partitions 125 and 126 may each be a wall member that is integrally formed with the shell portion 120, or the partitions may each be a separate part that is fixedly secured within the interior of the upper compartment 20U. In addition, rather than being fixedly secured, the partitions 125 and 126 may instead be formed of a flexible material, such as vinyl, cloth, cloth covered plastic, or leather, and/or may be releasably secured within the upper compartment 120U using Velcro or snaps or the slots shown in FIG. 10B, so that the user may be able to customize and transform the size and shape of the sub-compartments therein.

As seen in FIG. 19, the partitions 125 and 126 may be oriented and positioned in the upper compartment 120U so that the sub-compartments 122 and 123 may each be used to store a pair of shoes therein. Each compartment may be felt lined to safely transport expensive designer shoes. The option of being able to relocate partition 121 (see e.g., partition 21 in FIG. 7 repositioned to become partition 21A) and of using the smaller case assembly 49A seen in FIGS. 10 and 10A to reduce the size of the lower compartment, may permit a user who has larger feet, and correspondingly larger shoes, to expand the length of the shoe sub-compartments. The flange on the end of the partitions 125 and 126, as seen in FIG. 19, may have cloth-covered segmented sections that may have Velcro fixedly secured thereon, which may easily facilitate extending the length of the sub-compartments when the partition 121 may be adjusted to accommodate a different sized case assembly in the lower compartment 120L. (Note, as stated hereinabove, the shoes stored in sub-compartments 122 and 123 may be accessed from outside the suitcase when the suitcase is closed, by using the exterior flaps 22Ei and 22Eii, seen in FIG. 1).

However, another problem encountered in the carrying of shoes in a suitcase, is that they may soil the clean clothes therein, and ordinarily may need to be placed in a separate plastic bag before being packed within the suitcase. Therefore, the second shell portion 120 may have respective flaps 122F and 123F be secured thereto (see FIG. 21A), to releasably enclose each of the sub-compartments 122 and 123. A lower side of the flap 122F may be fixedly secured to the second shell portion 20, and may also be releasably securable on each of its other three sides, to permit quick access to the sub-compartments and the shoes therein. Releasable securing of the three sides of the flaps 122F and 123F may be through the use of a zipper, or it may instead be through the use of Velcro, or snap fasteners, etc. The flaps 122F and 123F may be made of a flexible translucent plastic, or another suitable material, that may have strips of the Velcro (hook or loop material) fixedly secured to at least three of its sides.

When the traveler may seek to open one of the flaps by pulling on it to disengage the hook and loop materials, while the second shell is leaning against the wall (FIG. 21A), the second shell may tend to be pulled away from the wall, so that the traveler may need to use their other hand to restrain the second shell portion. To limit such movement of the second shell portion away from the wall, a strap 142 may releasably attach to the base shell 110 and to the second shell portion 120 (e.g., using a buckle or snap fasteners as seen in FIG. 21A), to bias the second shell to tend to remain positioned against the wall. The strap 142 may thus be made of an elastomeric material, or it may instead be made of a non-elastic material.

To accommodate the above-described expansion of the sub-compartments 122-124 by the relocation of the partition 121, the flaps 122F and 123F may have the Velcro on all four of its sides, and the length of the flaps may be longer than is required for the sub-compartments formed when the partition 121 is positioned for the lower compartment 120L to receive the full height case assembly 49 therein. The excess length of the flaps may be used to cover the opening to the sub-compartments when they are increased in size and the low-height case assembly 49A is instead utilized.

In another embodiment, the inner surface of the bottom 123FB of flap 123F may be releasably secured to the shell 120 using Velcro or snaps, rather than being fixedly secured thereto, and the inner surface of the upper end 122FT of flap 122F may be releasably securable to the outside surface of the bottom 123FB of flap 123F. This would permit the user to completely remove the partition 125 from the suitcase 102 to create a single larger sub-compartment that would combine the space of sub-compartments 122 and 123. This embodiment may be desirable for the situation where a traveler purchases a smaller sized suitcase 102, but the traveler has very large feet and may wear, for example, size 13 shoes. Access to the compartment may then be through the top of the combined flaps 122F and 123F.

Alternatively, a single flap may cover both openings for the sub-compartments 122 and 123. Similarly, in another embodiment, a single flap may be used for the covering of all three of the sub-compartments (122, 123, and 124) of the upper compartment 120U, and may be fixedly secured at its bottom to the shell 120 (proximate to the hinges), and its three sides may be secured using Velcro. This embodiment may permit the traveler to remove partitions 125 and 126 shown in FIG. 21 and re-orient one of them to extend in the other direction (e.g., parallel to partition 121), so that it creates only two sub-compartments in the upper compartment 120U, which may then store two extra large pairs of shoes or even boots.

Where individual flaps are utilized, as seen in FIG. 21A, access may be through the tops of each of the flaps 122F and 123F, each of which may be disposed on the side of the sub-compartments being farthest from the hinge 41. This would enable better access to the shoe sub-compartments 122 and 123, when the second shell portion 120 is disposed against a wall, and the first compartment is resting on the ground/floor.

The third sub-compartment 124 may also include a flap, similar to the flaps 122F and 123F of sub-compartments 122 and 123, and it may be used to store a third pair of shoes. However, for sub-compartment 123 to be better adapted to carry a blow dryer therein, which does not similarly require the plastic flap to prevent the egress of debris therefrom, the third sub-compartment 124 may instead utilize an elastic fishnet restraint 124N. The bottom end 124NB of the fish net 124N may be fixedly secured to the partition 126, and the two sides of the fishnet 124N may respectively be fixedly secured to the second shell portion 120 and the partition 121. The top of fishnet 124N being unrestrained may thus be elastically stretched, to permit the user to increase the gap for placement therein or removal therefrom of the blow dryer from the sub-compartment 124.

The first shell portion 110 and the second shell portion 120 of suitcase 102 in FIG. 19 may each respectively have a handle 110H/120H pivotally attached thereto. The handles may provide better structural support for carrying of the suitcase, as each of the shell portions may roughly be evenly weighted. The handles 11011/12011 may snap together when the shell portions are closed, or they may be releasably joined together using Velcro.

Figure 24:
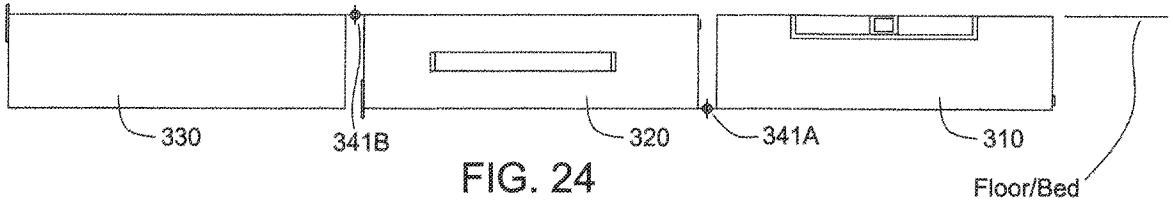
FIG. 24 is a top view of the suitcase of FIG. 23.
Figure 23:
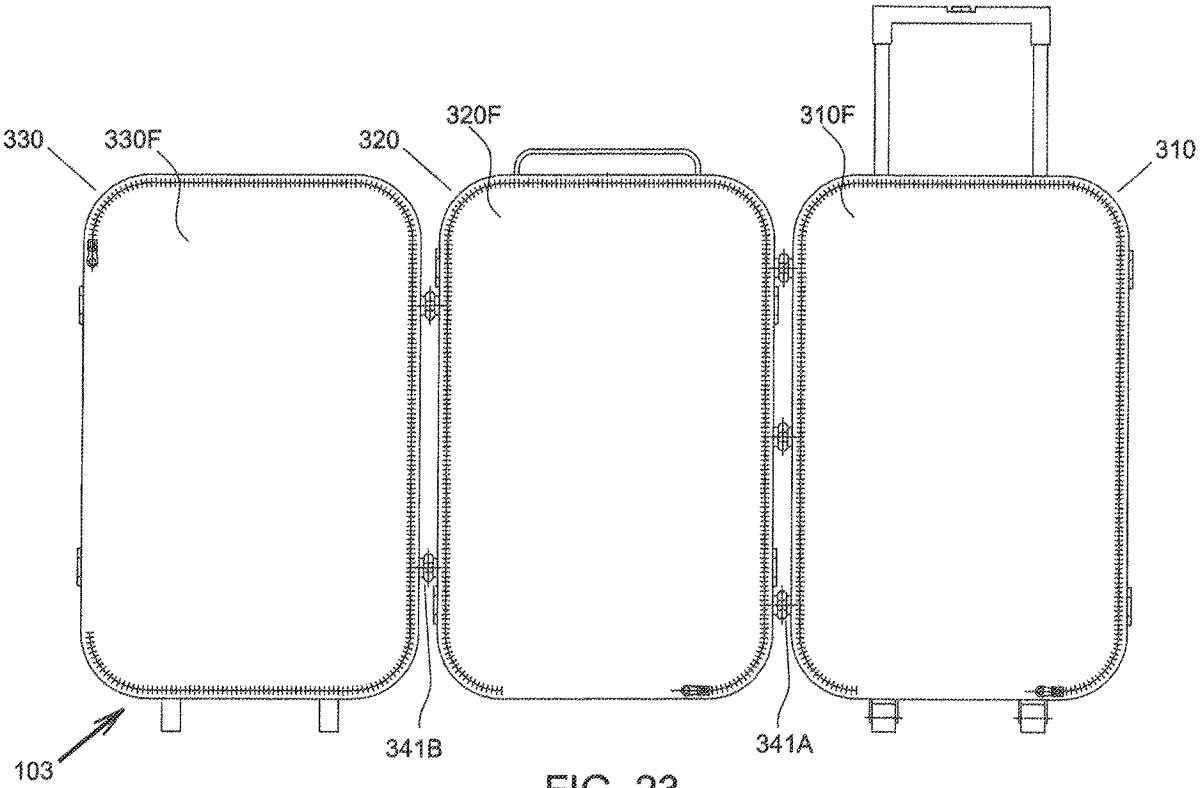
FIG. 23 shows an alternate embodiment of the suitcase of FIG. 1, configured to form a tri-fold arrangement with a base shell portion, a second shell portion, and a third shell portion, with each being shown in an open position.
Figure 26:
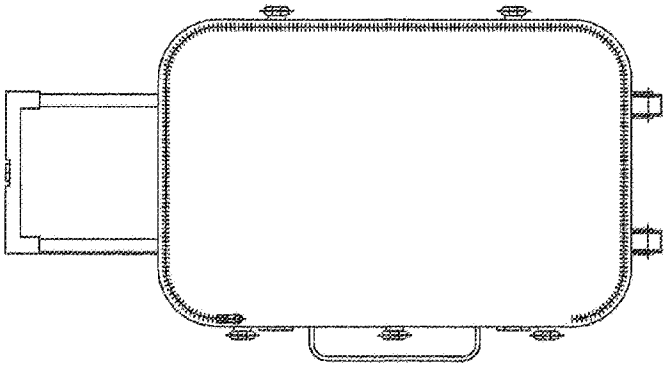
FIG. 26 is a side view of the suitcase of FIG. 25.
Figure 25:
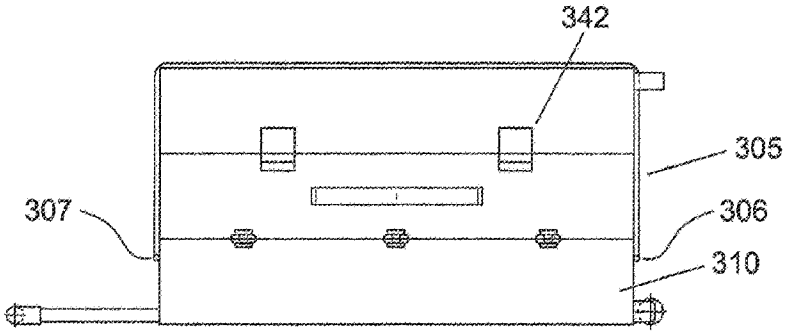
FIG. 25 is a side view of the suitcase of FIG. 23, shown with all three shell portions in a closed position.
Figure 27:
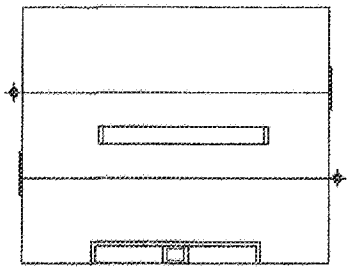
FIG. 27 is a top view of the suitcase of FIG. 25.
Figure 29:
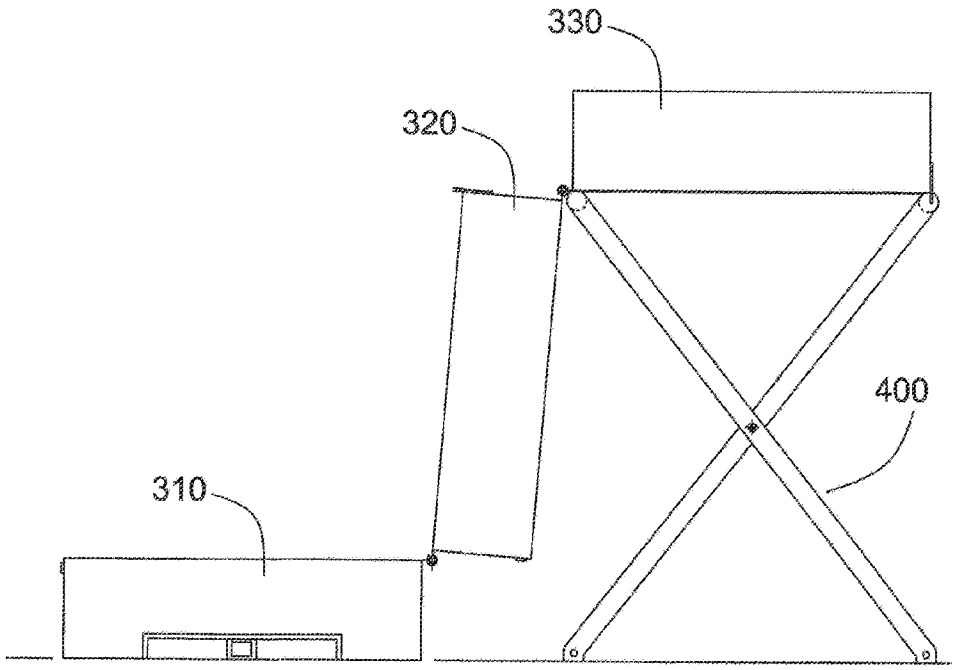
FIG. 29 is a side view of the opened suitcase of FIG. 28.

Further improvements according to another suitcase embodiment of the present invention may be seen for suitcase 103, which is shown within FIGS. 23-31, and which solves other organization problems with respect to the items in the traveler's suitcase. Suitcase 103 provides even greater access to the traveler's packed items while at the destination, which may be a hotel that generally has a luggage rack to support the suitcase for easy access therein. Suitcase 103 may therefore be particularly configured to be opened in conjunction with the luggage rack (e.g., FIGS. 28 and 29), but, because of the particular arrangement of its hinges and flaps, may also be conveniently opened and accessed when sitting upon the traveler's bed or the floor of their home (FIGS. 23-24).

Therefore, suitcase 103 may include a base shell portion 310 having an opening defining an interior, a second shell portion 320 having an opening defining an interior, and one or more hinges configured to pivotally attach a first side of the second shell portion to a first side of the base shell portion, such that when the second shell is pivoted into a closed position with respect to the base shell, the respective openings are opposed to each other (i.e., facing each other at the faying surface between the shell portions). As such, the openings of the base shell portion 310 and the second shell portion 320 may thus operate to cover each other, when the base shell portion and second shell portion are in the closed position.

Also, the suitcase 103 may include a third shell portion 330 having an opening defining an interior. The third shell portion 330 may be hingedly coupled to the second shell portion 320, such that when the third shell is pivoted into a closed position with respect to the second shell, the respective openings are not facing each other, and may instead be on distal surfaces of the shell portions.

To assist in retaining the garments and other items that have been packed in the third shell portion 330, it may include a flap 330F that may be releasably secured to the shell, the same as for suitcases 101 and 102. In addition, the second shell portion 320 and the base shell portion 310 may also include a zippered flap (320F and 310F), or a buttoned flap, or a flap secured by Velcro, etc.

When the base shell portion 310, the second shell portion 320, and the third shell portion 330 are pivoted into the respective closed positions, a strap 305 (FIG. 25) may be used to retain the shell portions in such positioning. The strap 305 may have a first end with a clasp that may be releasably coupled to a loop 306 that may be fixedly secured to a first side of the base shell portion 310, and a clasp on a second end of the strap that may be releasably coupled to a loop 307 that may be fixedly secured to a second side of the base shell portion. Alternatively (or additionally), one or more latches 342 may be used for releasably securing the second shell portion 320 to the base shell portion 310, and for releasably securing the third shell portion 330 to the second shell portion 320. It should be noted that the depth of each of the shell portions 310, 320, and 330, as seen in FIG. 24 and throughout many of the other Figures, although illustrated therein to generally have the same depth, may instead be formed to have different depths.

As seen in FIG. 24, the hinge(s) 341A that may be used to pivotally couple the second shell portion 320 to the base shell portion 310, may be fixedly secured to the shell portions at a depth that is substantially opposite from the portion of the shell that may be resting upon the floor/bed (i.e., is in proximity to the side of the shell portions with the openings into the respective interiors). Also, the hinge(s) 341B that may be used to pivotally couple the third shell portion 330 to the second shell portion 320 may be fixedly secured to the shell portions at a depth that is substantially in proximity to the portion that is resting upon the floor/bed (i.e., the opposite depth from which the hinges 341A are secured). This creates a tri-fold arrangement, in which a first fold—the folding of the second shell portion 320 with respect to the base shell portion 310—is an inward fold, and where a second fold—the folding of the third shell portion 330 with respect to the second shell portion 320—is an outward fold.

Figure 28:
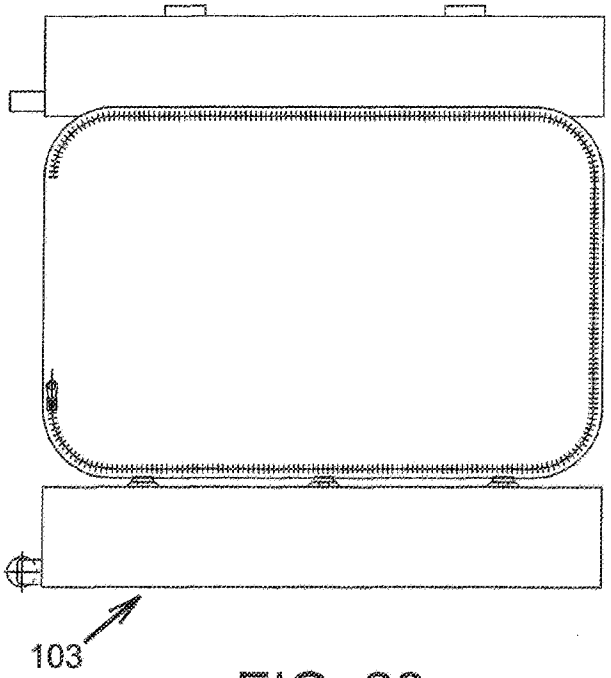
FIG. 28 shows the suitcase of FIG. 25 having been opened with the base shell portion resting upon the floor, with the third shell portion resting upon a hotel luggage rack, and with the second shell portion positioned therebetween and being substantially upwardly disposed.
Figure 30:
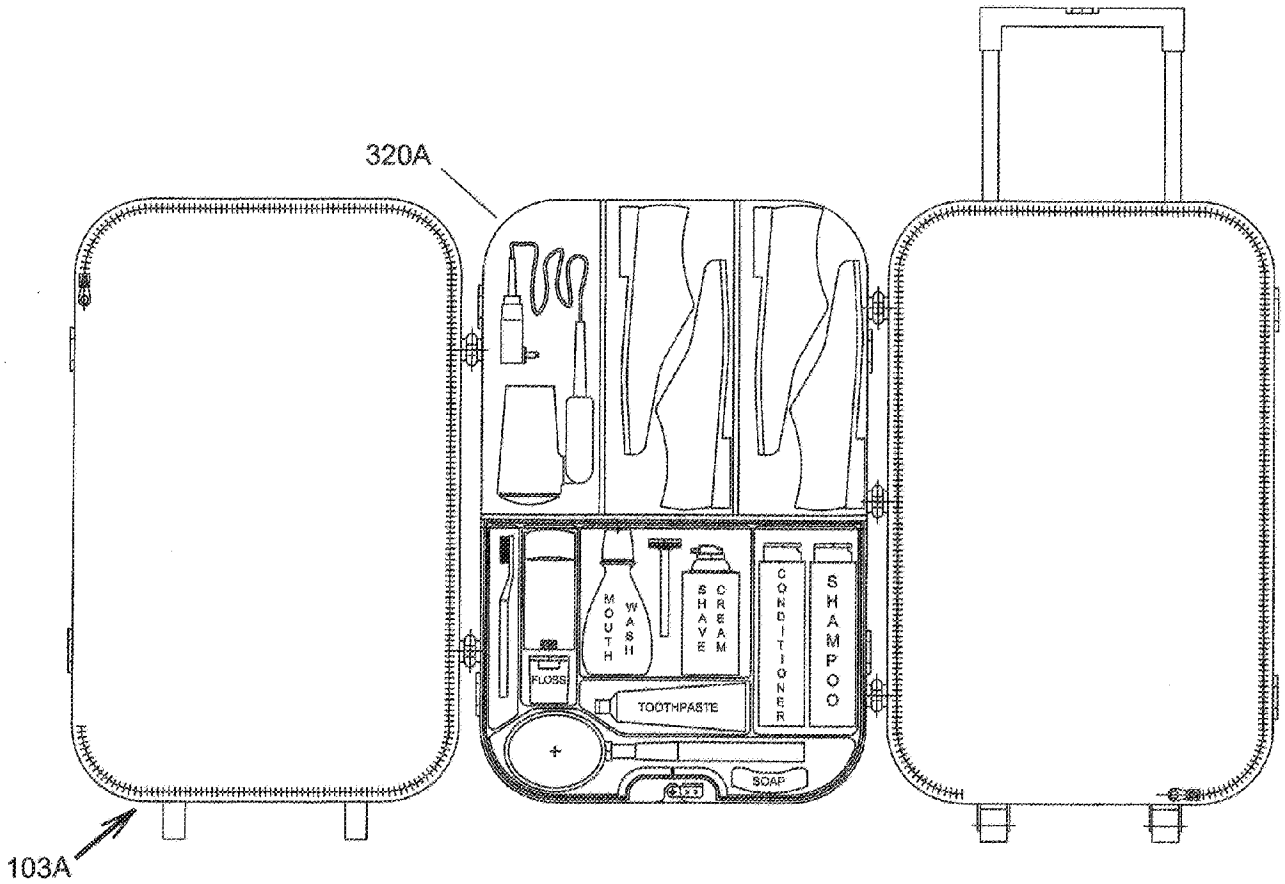
FIG. 30 is the suitcase embodiment of FIG. 23, but which also includes the partitioning of the upper compartment of the second shell to form the shoe and blow-dryer sub-compartments shown for the suitcase embodiment of FIG. 19.

This arrangement for the hinges 341A and 341B with respect to the base shell portion 310, the second shell portion 320, and the third shell portion 330, may permit the tri-fold suitcase 301 to have the bottom surface of its base shell be positioned on the floor of a hotel room, to be in proximity to a luggage rack, as seen in FIG. 28. The width of the shell portions may be sized so that the second shell portion 320 may be configured to pivot open relative to the base shell portion 310 to be disposed substantially upright, when the third shell portion is positioned to sit atop the hotel luggage rack 400. This may serve to maximize the traveler's access into the shell portions to be able to conveniently retrieve any single particular item stored therein, even if it may be disposed at the bottom of one of the shells, while tending to minimize the floor space that must be utilized.

Figure 32:
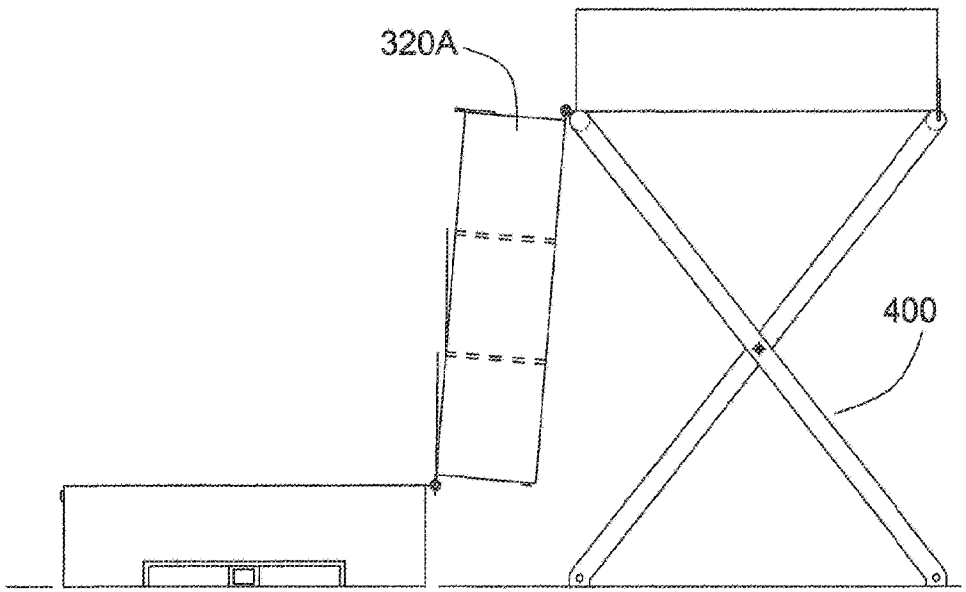
FIG. 32 is a side view of the opened suitcase of FIG. 31.

In an alternate embodiment of suitcase 301, the second shell portion 320A of suitcase 310A (FIG. 30), rather than having a zippered flap, may instead be configured with the same compartments and sub-compartments that were used for the suitcase 102 shown in FIG. 22. This may enhance the accessibility to the traveler of items stored in the sub-compartments, which may thus be easily accessible from an upwardly disposed side of each sub-compartment, as seen in FIGS. 31 and 32.

Figure 18:
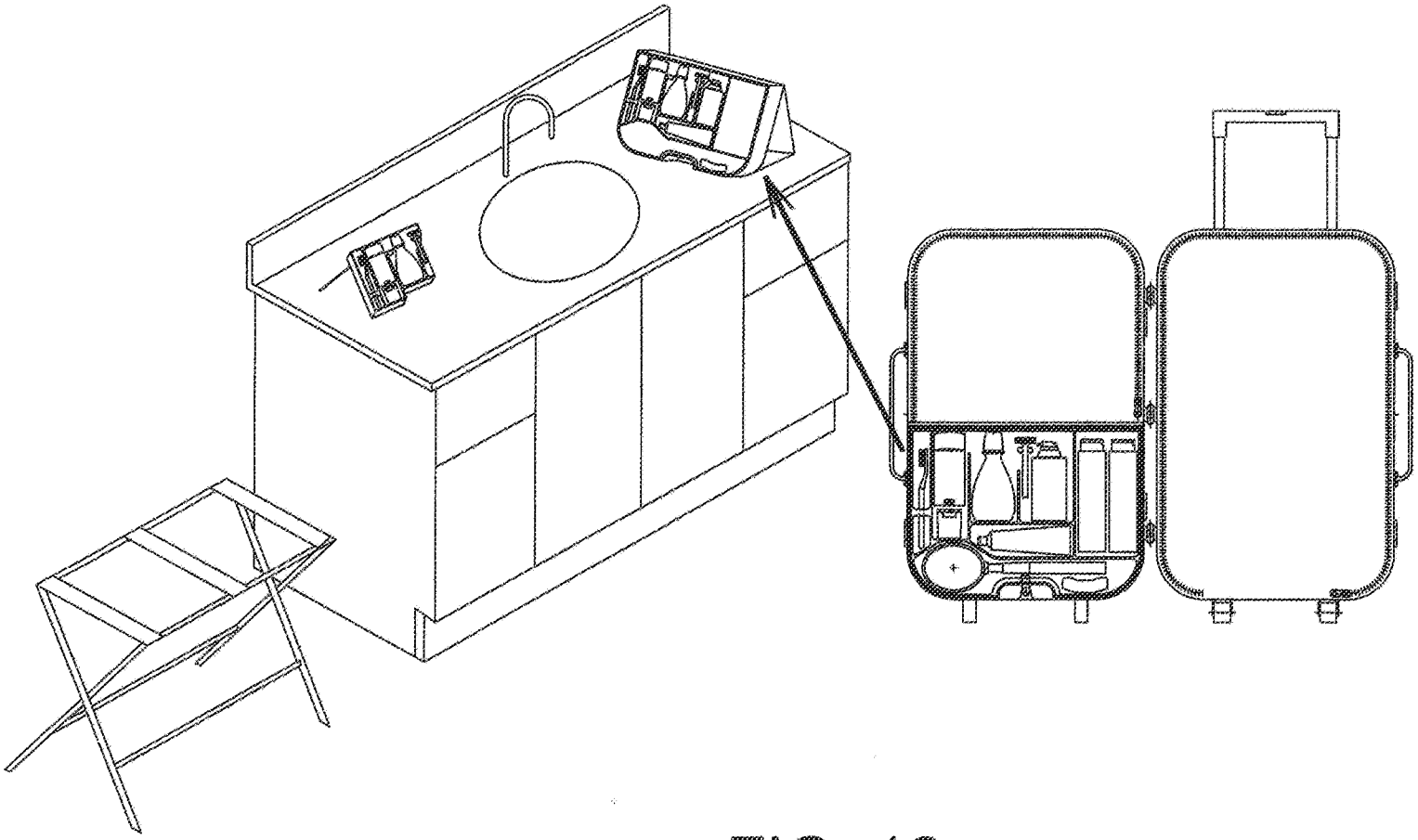
FIG. 18 illustrates the suitcase of FIG. 5 having been positioned near the vanity in a hotel room, and further illustrates that the case assembly therein may be positioned on the vanity countertop in the display configuration, and that the tray of FIG. 9A may be removed from the case assembly and be separately positioned on the vanity countertop to also be displayed thereon.
Figure 31:
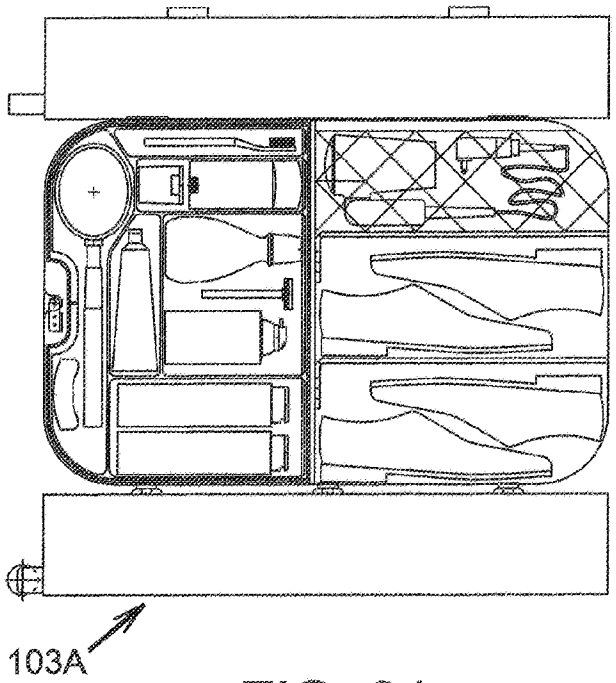
FIG. 31 shows the suitcase of FIG. 30 having been opened with the base shell portion resting upon the floor, with the third shell portion resting upon a hotel luggage rack, and with the second shell portion positioned therebetween and being substantially upwardly disposed.

When a traveler arrives at the hotel, he/she may wheel the suitcase 301 into the room and position it before the luggage rack 400, and may unlatch and pivot open the shell portion(s) to be as seen in FIG. 22 or 31. The traveler may next remove the case assembly 49, walk into the bathroom of the hotel room, open the sealed cover of the case assembly, and place the shampoo, conditioner, soap, and back scrub brush by the bath tub. The traveler may next convert the case 49 into the display stand and place it upon the vanity countertop as seen in FIG. 18, where it may display and protect the toiletry items therein until needed, and conveniently accessed by the traveler.

When the traveler is packing to check out of the hotel room at the end of the stay, the reverse process may be followed to conveniently pack all of the personal toiletry items. Having a corresponding place in the case assembly 49 for each item may help to assure that the traveler does not forget any of the items that were brought on the trip.

The examples and descriptions provided herein merely illustrate certain embodiments of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

What is claimed is:

1. A case assembly, for use in a suitcase, said case assembly configured for carrying toiletry items in a substantially leak-proof manner within the suitcase, and for subsequent open displaying of the toiletry items for easy access, said case assembly comprising:

a case having a first side and a second side, and comprising an opening in said first side into an interior, said interior for use in receiving the toiletry items;

a cover, said cover configured to enclose said opening in said first side of said case, in a closed position;

a cover support arm, a first end of said cover support arm pivotally coupled to said cover, and a second end of said cover support arm pivotally coupled to a top of said case, to permit pivotal movement of said cover from said closed position to an open position;

means for releasably securing at least a portion of said cover to at least a portion of said case, in said closed position;

a display arm pivotally coupled to said cover, and configured to be releasably coupled to a portion of said case, to support said case cover at said open position at a desired angle with respect to said case, said open position configured for said case, said case cover, and said cover support arm to form a triangular shape to provide stable upright support for said case; and means for liquid-tight sealing of said case cover with respect to an entire periphery of said opening in said first side of said case, with said cover in said closed position, for use in preventing leakage of fluid from said case assembly into the suitcase.

2. The case assembly according to claim 1 wherein at least a portion of an exterior of said case assembly comprises a contour configured to match a portion of an interior contour of the suitcase, and an extent configured to extend to a full depth of the suitcase to optimize space occupied therein.

3. The case assembly according to claim 2 wherein said second end of said cover support arm is pivotally coupled to said top of said case between said first and second sides of said case.

4. The case assembly according to claim 3 wherein said pivotal coupling of said cover support arm to said top of said cover between said first and second sides comprises pivotal coupling proximate to a mid-point between said first and second sides of said top of said case.

5. The case assembly according to claim 4 wherein a length of said cover support arm is configured to result in said second end of said cover being in proximity to said first end of said case, when said cover is in said closed position, and to be in proximity to said second end of said case when said cover is in said open position.

6. The case assembly according to claim 5 wherein said display arm pivotally coupled to said cover comprises a first end of said display arm being pivotally coupled to a bottom portion of said cover.

7. The case assembly according to claim 6 wherein said display arm is further configured to be releasably coupled to a portion of said case liar display of said interior of said case at one or more additional open positions, with a portion of said case configured to be positioned in static contact with respect to a portion of said display arm, to support said case at said one or more open positions.

8. The case assembly according to claim 7 wherein said display arm configured to be releasable coupled to said case comprises a slip-resistant material used for at least a portion of said display arm and for at least a portion of said bottom of said case, in proximity to said static contact therebetween.

9. The case assembly according to claim 7 wherein said display arm configured to be releasable coupled to said case comprises: a piece of hook material and a piece of loop material, said pieces of material being fixedly secured, respectively, to a portion of said display arm and to a portion of said case.

10. The case assembly according to claim 7 wherein said display arm configured to be releasable coupled to said case comprises comprising means for releasably securing a portion of said display arm to a portion of said case, for releasably inhibiting said pivotal movement of said display arm, at the desired angle.

11. The case assembly according to claim 10 wherein said interior of said case comprises one or more partitions configured to form a plurality of selectively shaped sub-compartments, with each said selectively shaped sub-compartment configured to respectively receive a correspondingly shaped toiletry item therein.

12. A case assembly, for use in a suitcase, said case assembly comprising:

a case having a first side and a second side, and comprising an opening in said first side into an interior, said interior for use in storing toiletry items therein;

a cover configured to enclose said opening in said first side of said case, in a closed position;

a cover support arm, a first end of said cover support arm pivotally coupled to said cover, and a second end of said cover support arm pivotally coupled to a top of said case, to permit pivotal movement oaf said cover from said closed position to an open display position;

means for releasably securing at least a portion of said cover to at least a portion of said case, in said closed position;

a display arm pivotally coupled to said cover, and configured to be releasably coupled to a portion of said case, to support said case cover at said open display position at a desired angle with respect to said case, said open display position configured for said case, said case cover, and said cover support arm to form a triangular shape to provide stable upright support for said case;

an elastomeric seal member about an entire periphery of said case, proximate to said opening in said case; and wherein said means for releasably securing said cover in said closed position is configured, in combination with said elastomeric seal member, to liquid-tight seal said interior of said case when said cover is in said closed position.

* * * * *